US007832580B2

(12) United States Patent
Jackman

(10) Patent No.: US 7,832,580 B2
(45) **Date of Patent: *Nov. 16, 2010**

(54) TAMPER EVIDENT CONTAINER SEAL WITH INTEGRAL PULL OPENER

(76) Inventor: Brian Francis Jackman, 39 Park St., Hudson, MA (US) 01749

( * ) Notice: Subject to any disclaimer, the term of this patent is extended or adjusted under 35 U.S.C. 154(b) by 1298 days.

This patent is subject to a terminal disclaimer.

(21) Appl. No.: 10/939,541

(22) Filed: Sep. 13, 2004

(65) Prior Publication Data

US 2006/0054584 A1 Mar. 16, 2006

(51) Int. Cl.
*B65D 53/00* (2006.01)
*B65D 51/20* (2006.01)
*B65D 41/00* (2006.01)

(52) U.S. Cl. ..... 215/347; 215/349; 215/232; 220/258.2; 220/359.3

(58) Field of Classification Search ..... 215/258, 215/232, 253, 254, 347, 349, 250, 270; 220/258.1–258.3, 220/280, 359.1–359.4, 270
See application file for complete search history.

(56) References Cited

U.S. PATENT DOCUMENTS 710,219 A * 9/1902 Snow ..... 215/253
749,423 A 1/1904 Chapman
2,438,671 A * 3/1948 Marana ..... 215/347
2,925,188 A 2/1960 Grumbles
3,501,042 A 3/1970 Risch
3,632,004 A 1/1972 Grimes
3,900,125 A 8/1975 Wyler
3,961,566 A 6/1976 Westphal
3,988,185 A 10/1976 Johnson
4,030,630 A * 6/1977 Yealy ..... 220/258.2
4,126,244 A * 11/1978 Elser ..... 220/268
4,126,245 A 11/1978 Baroody
4,209,126 A 6/1980 Elias
4,256,239 A * 3/1981 Yamaguchi et al. ..... 220/270
4,523,689 A 6/1985 Laub
4,625,875 A 12/1986 Carr
4,637,519 A 1/1987 Dutt
4,643,329 A * 2/1987 Mobberley et al. ..... 220/257.2
4,682,702 A 7/1987 Gach
4,722,447 A 2/1988 Crisci
4,724,978 A 2/1988 Cleevely
4,727,999 A 3/1988 Gach
4,739,891 A 4/1988 Bullock
4,739,892 A 4/1988 Tudek
4,754,890 A 7/1988 Ullman
4,760,931 A 8/1988 Gach
4,778,698 A 10/1988 Ou-Yang
4,815,618 A 3/1989 Gach (Continued)

*Primary Examiner*—Robin Hylton

(57) ABSTRACT

A tamper evident container closure seal with an integral pull opener is constructed from one or more layers of frangible sheet material adhesively bonded to one or more layers of strengthening sheet material. The one or more strengthening layers each contain one or more duplicate void configurations that form a weak area in the multi layered seal only in the area of the void configuration. When a consumer forces a finger into the seal when bonded to the rim of a container the applied pressure forces the seal to break open and tear only in the weaker area of the void configuration while the peripheral portion of the seal remains bonded to the container rim. The broken open center portion of the seal then forms a pull tab that can be partially connected which allows the pull tab to be lifted back out and pulled from the container.

13 Claims, 11 Drawing Sheets

U.S. PATENT DOCUMENTS 4,819,819 A 4/1989 Robertson
4,863,047 A 9/1989 Crow
4,863,061 A 9/1989 Moore
4,869,383 A 9/1989 Bahr
4,872,571 A 10/1989 Crecelius
4,890,758 A 1/1990 Gailus
4,917,949 A * 4/1990 Yousif ..... 428/349
4,934,544 A 6/1990 Han
4,960,216 A 10/1990 Giles
4,961,986 A 10/1990 Galda
4,981,229 A 1/1991 Lanham
5,004,111 A 4/1991 McCarthy
5,012,946 A 5/1991 McCarthy
5,022,551 A * 6/1991 Hexel ..... 220/270
5,119,964 A 6/1992 Witt
5,121,845 A 6/1992 Blanchard
5,156,286 A 10/1992 Piccard
5,176,271 A 1/1993 Painchaud
5,184,746 A 2/1993 Moore
5,197,618 A 3/1993 Goth
5,265,745 A 11/1993 Pereyra
5,341,948 A 8/1994 Gaeta
5,372,268 A 12/1994 Han
5,415,306 A 5/1995 Luch
5,433,992 A 7/1995 Galda
5,513,781 A 5/1996 Ullrich
5,514,442 A 5/1996 Galda
5,551,608 A 9/1996 Moore
5,560,989 A 10/1996 Han
5,664,694 A 9/1997 Bietzer
5,702,015 A 12/1997 Giles
5,720,401 A 2/1998 Moore
5,797,509 A 8/1998 Fitch
5,860,544 A 1/1999 Brucker
5,887,738 A 3/1999 Bietzer
5,887,747 A 3/1999 Burklin
5,915,578 A 6/1999 Burt
5,927,530 A 7/1999 Moore
6,082,568 A 7/2000 Flanagan
6,179,147 B1 1/2001 Mogard
6,461,714 B1 10/2002 Giles
6,474,490 B1 11/2002 Seibel
6,790,508 B2 * 9/2004 Razeti ..... 428/138
7,237,698 B2 * 7/2007 Jackman ..... 222/541.4
2005/0150981 A1 * 7/2005 Strong ..... 239/589

* cited by examiner

TAMPER EVIDENT CONTAINER SEAL WITH INTEGRAL PULL OPENER

Elements of the inventive concept disclosed in the specification contained herein also appear in my co-pending U.S. patent application Ser. No. 10/694,137 Filed Oct. 27, 2003 and U.S. patent application Ser. No. 10/761,063 Filed Jan. 20, 2004.

FIELD OF THE INVENTION

The invention resides in the area of container seals, specifically a tamper evident leak proof closure with an integral pull opener for sealing over the mouth opening of various types of rigid and semi rigid containers typically used for the storage and dispensing of a wide variety of consumer, commercial, and industrial products such as; ingestible products; food; health care products; personal care products; household products; or garage products and the like.

BACKGROUND OF THE INVENTION

A wide variety of consumer and commercial products such as; ingestible products; food; health care products; personal care products; household products; or garage products and the like, are packaged and sold to consumers in many different types of rigid and semi rigid containers. These containers can vary in size and shape, but generally consist of a tubular body portion with a bottom end sealed by a wall end. The opposite top end incorporates an open mouth that includes means for securing a closure cap. The mouth opening ends with an exterior rim, perpendicular to the bore of the container, that provides a surface area for sealing the opening with the closure cap. These containers can be constructed from one or more types of material such as; plastic; glass; metal; or paperboard.

Many of the products that are packaged and sold to consumers in these containers require the container to have, in addition to the closure cap, a closure seal that serves a number of practical and important functions such as; maintaining a hermetic seal to keep air, moisture, and contaminants away from the product; to prevent any leakage; and also to prevent tampering with the container contents by leaving telltale evidence when the seal has been removed.

The packaging industry has developed a wide variety of seals and sealing methods to fulfill these requirements such as; seals that are bonded to the container rim by pressure sensitive, evaporative, or reactive adhesives; seals that are thermally bonded to the container rim with a hot melt adhesive that is activated by an external heat source; or, most commonly, seals that are thermally bonded to the container rim with a hot melt adhesive that is activated by induction sealing.

Induction seals generally consist of a layer of metal foil sheet material that has one side coated with a layer of hot melt adhesive. The opposite side of the foil layer can be bonded to a variety of additional sheet materials such as; releasable stiffeners; permanent stiffeners; or resealing liners, etc. Finished seal disks are die cut from prefabricated rolls of this varied composite sheet material and inserted into the closure cap which is then installed over the container opening by press fit or complimentary screw threads. The installed closure cap presses the hot melt adhesive side of the inserted seal disk against the container rim. The container is then passed through an induction sealer that generates a high voltage discharge which is conducted by the metal foil layer of the seal causing it to heat up. The hot foil layer in turn melts the hot melt adhesive layer which bonds the seal to the container rim.

Induction sealing is well known and widely used through out the packaging industry. It provides many advantages and benefits over other sealing methods such as:

- Induction seals provide a low cost, leak proof closure that is reliable and can be manufactured and installed at high speed.
- The hot melt adhesive layer creates a bond between the seal and the container rim that is stronger than the seal itself which forces the seal to tear along the inside perimeter of the rim when the seal is broken and pulled from the container opening. This leaves the peripheral portion of the seal bonded to the container rim thereby indicating to a consumer that the seal has been removed and the contents may have been tampered with.
- The seal is destroyed during the opening procedure which prevents the seal from being able to be reinstalled on the container after its removal.

However, the same material properties and performance characteristics that provide induction seals with advantages over other sealing methods such as strength, durability, and ease of installation, also, by nature, create considerable drawbacks.

The combination of the metal foil layer together with the hot melt adhesive layer produces a seal of substantial strength. Although a strong seal is desirable, the strength of the multi layered construction also makes the installed seal extremely difficult to break open and remove from the container. The amount of force required to initiate a tear in a typical induction seal so it can be pinched and removed from the container opening cannot be easily applied by a consumer forcing a finger into the seal to break it. A sharp opening device such as a knife is usually needed to first cut an opening in the seal. This allows the consumer to then insert a finger into the opening so that the seal can be pinched between the consumers fingers and then pulled from the container. Even after the seal is cut open, its high tear resistance often makes it difficult for many consumers to apply enough pinching force to pull and tear the seal from the container without the seal slipping out from between the consumers fingers. The high strength bond created by the hot melt adhesive also prevents the seal from being able to be pulled from the rim by pinching and pulling the small area of the seal that may overhang the rim of the container.

These drawbacks are well known and present a number of significant disadvantages for the consumer such as:

- The need to provide a sharp device such as a knife in order to cut open the seal is an inconvenience.
- Portions of the seal material may tear away when the seal is either being cut, broken open, or pulled from the container which could contaminate the container contents.
- The consumer could be cut by either the sharp opening device when attempting to cut the seal or, by the jagged edge of the cut foil itself while attempting to pinch and pull the seal from the container opening.
- The peripheral portion of the seal remains bonded to the container rim, which prevents the container from being able to be cleanly recycled.

To overcome these well known disadvantages the packaging industry has developed and been granted numerous patents for container closure seals that include various types of integral openers that provide for the tool free removal of the seal from the container by either initiating a tear in the seal, or by the ability of the integral opener to remove the entire seal, or a portion of it, from the container when the opener is pulled by a consumer.

A first method of providing a container closure seal with an integral opener is by including a peripheral pull tab. The tab protrudes from the periphery of the seal and is usually formed from a portion of the seal material itself when the seal is die cut. The tab is large enough to be pinched by a consumer which then allows the seal to be pulled from the container. These pull tabs require the seal to use an adhesive with a bond strength that is weaker than the strength of the seal material which allows the seal to release from the container rim before the tab tears from the seal.

A crowded field of prior art patents disclose numerous variations of peripheral pull tabs that allow for the removal of a sealing closure from a container such as shown in U.S. Patents: U.S. Pat. No. 6,474,490 to Seibel; U.S. Pat. No. 5,927,530 to Moore; U.S. Pat. No. 5,915,578 to Burt; U.S. Pat. No. 5,887,738 to Bietzer; U.S. Pat. No. 5,860,544 to Brucker; U.S. Pat. No. 5,797,509 to Fitch; U.S. Pat. No. 5,720,401 to Moore; U.S. Pat. No. 5,664,694 to Bietzer et. al.; U.S. Pat. No. 5,551,608 to Moore et. al.; U.S. Pat. No. 5,513,781 to Ullrich; U.S. Pat. No. 5,415,306 to Luch et. al.; U.S. Pat. No. 5,372,268 to Han; U.S. Pat. No. 5,341,948 to Gaeta; U.S. Pat. No. 5,197,618 to Goth; U.S. Pat. No. 5,184,746 to Moore et. al.; U.S. Pat. No. 5,176,271 to Painchaud et. al.; U.S. Pat. No. 5,156,286 to Piccard; U.S. Pat. No. 5,121,845 to Blanchard; U.S. Pat. No. 5,119,964 to Witt; U.S. Pat. No. 5,012,946 to McCarthy; U.S. Pat. No. 4,981,229 to Lanham; U.S. Pat. No. 4,890,758 to Gailus; U.S. Pat. No. 4,872,571 to Crecelius et. al.; U.S. Pat. No. 4,869,383 to Bahr et. al.; U.S. Pat. No. 4,863,061 to Moore; U.S. Pat. No. 4,778,698 to Ou-Yang; U.S. Pat. No. 4,760,931 to Gach; U.S. Pat. No. 4,754,890 to Ullman; U.S. Pat. No. 4,739,891 to Bullock, III; U.S. Pat. No. 4,727,999 to Gach; U.S. Pat. No. 4,724,978 to Cleevely et. al.; U.S. Pat. No. 4,722,447 to Crisci; U.S. Pat. No. 4,682,702 to Gach; U.S. Pat. No. 4,637,519 to Dutt et. al.; U.S. Pat. No. 4,625,875 to Carr et. al.; U.S. Pat. No. 4,523,689 to Laub; U.S. Pat. No. 4,209,126 to Elias; U.S. Pat. No. 3,988,185 to Johnson et. al; U.S. Pat. No. 3,961,566 to Westphal et. al.; U.S. Pat. No. 3,900,125 to Wyler et. al.; U.S. Pat. No. 3,632,004 to Grimes; U.S. Pat. No. 3,501,042 to Risch; U.S. Pat. No. 2,925,188 to Grumbles; and U.S. Pat. No. 749,423 to Chapman.

Although a peripheral pull tab provides the means for removing a closure seal from a container, the presence of the tab itself also creates a number of hindrances to the efficient fabrication and installation of the seal.

As stated induction sealing generally requires that the seal first be inserted into the closure cap. However, when a peripherally tabbed seal is pushed into the closure cap, the protruding tab is left positioned at a right angle up against the inner sidewall of the cap. If the tab is left in this position, it will most likely pleat and crimp together as the cap is press fit or torqued on to the container by complimentary screw threads which will prevent the proper installation of both the cap and the seal. If an installation procedure can be used that successfully leaves the tab in the correct position, squeezed between the cap and the side of the container just below the rim, the same adhesive coating that bonds the seal to the rim will also bond the tab to the container during the induction sealing process. This prevents the tab from being able to be lifted up to pull the seal from the container when the cap is removed.

One method disclosed in the prior art to overcome these drawbacks is to fold the protruding tab back over on top of the seal prior to inserting the seal into the cap. However, inserting the seal into the closure cap with the tab folded back also brings the adhesive layer on the tab into contact with the underside of the cap which will cause the tab to bond to the inside of the cap when the seal is heated in the induction sealing process. To prevent this requires the use of an additional liner that is inserted into the cap prior to the seal that consists of a material that does not adhere to the adhesive layer on the tab when the seal is heated.

Other methods of preventing the tab from interfering with the insertion of the seal into the cap or the installation of the cap and the seal onto the container are also disclosed in the prior art such as:

- Including vertical grooves in either the cap or down the sidewall of the container adjacent to the rim for the tab to seat into.
- Angling outwardly an upper portion of the inner sidewall of the cap which prevents the tab from coming into contact with, and bonding to, the container neck.
- And various other methods of folding the tab etc.

Irrespective of the numerous design schemes disclosed in the prior art that attempt to perfect the manufacture and installation of a peripherally tabbed induction seal, a common and more intractable problem exists. During the induction heat sealing process the additional mass and uneven shape of the metal foil tab creates eddies in the induced high voltage current as it flows through the foil layer of the seal. These eddies cause the foil layer to heat unevenly which can prevent portions of the seal from completely bonding to the container rim. This phenomena is well known and understood by those skilled in the art. To minimize incomplete bonding of the seal requires that a number of variables in the induction sealing process and the fabrication of the seal must be kept within exact specifications, such as keeping the tab as small as possible. However, even with rigid quality and process control the problem of incomplete bonding of peripherally tabbed induction seals is still observed.

To overcome these drawbacks, manufacturers have developed a second type of pull open closure seal. The pull opener consists of various lift up tabs, pull rings, or pull members that are attached to the outer surface of the seal. Some of these openers may also be attached to the closure cap itself. These pull openers require the seal to use an adhesive with a bond strength that is weaker than the strength of the pull opener which allows the seal to release from the rim without the pull opener breaking or tearing from the seal. These various types of openers allow a consumer to remove the entire seal, or a portion of it, from the container which then allows the remainder of the seal to be removed from the container opening.

Again a crowded field of prior art patents disclose numerous variations of integral lift tabs or other pull openers that are attached to the outer surface of the seal and allow for the removal of a seal from a container rim such as shown in U.S. Patents: U.S. Pat. No. 6,461,714 to Giles; U.S. Pat. No. 6,179,147 to Mogard et. al.; U.S. Pat. No. 6,082,568 to Flanagan; U.S. Pat. No. 5,887,747 to Burklin et. al.; U.S. Pat. No. 5,702,015 to Giles; U.S. Pat. No. 5,560,989 to Han; U.S. Pat. No. 5,514,442 to Galda; U.S. Pat. No. 5,433,992 to Galda; U.S. Pat. No. 5,265,745 to Pereyra; U.S. Pat. No. 5,004,111 to McCarthy; U.S. Pat. No. 4,961,986 to Galda et. al.; U.S. Pat. No. 4,960,216 to Giles; U.S. Pat. No. 4,934,544 to Han; U.S. Pat. No. 4,863,047 to Crow; U.S. Pat. No. 4,819,819 to Robertson, Jr.; U.S. Pat. No. 4,815,618 to Gach; and U.S. Pat. No. 4,739,892 to Tudek; U.S. Pat. No. 4,126,245 to Baroody.

Although this second group of prior art seal designs incorporate various pull openers that overcome many of the disadvantages associated with prior art seals that use peripheral pull tabs, one drawback is that they generally require an increase in the number of manufacturing steps and a not insignificant increase in the amount of additional materials necessary to fabricate the opener, which can add substantially to the cost of the seal.

In addition to the various drawbacks associated with the many variations of the prior art pull open and non pull open induction seals, and summarized herein, an additional drawback of a more serious nature exists with pull open seals in general when the seal is to serve in a tamper evident capacity.

As stated, the installation of an induction seal is based upon heating the metal foil layer to a temperature sufficient to melt the adhesive layer, which after cooling, bonds the seal to the container rim. However, the drawback of using a hot melt type adhesive is that it also allows the installed seal to be easily removed from the container rim intact by simply reapplying sufficient heat to the seal. Additionally, with many prior art pull open type induction seals it is not even necessary to reapply heat to remove the seal intact since the integral opener often leaves the seal in an undamaged state after its removal from the container rim. In either case the intact seal can then be reinstalled on the same container by either reapplying sufficient heat or by applying a compatible adhesive to the seal.

A container seal that can be removed and then replaced in this manner allows a malicious person intending to do harm to another, to adulterate the contents of the container without leaving any evidence of such adulteration. If the seal is required to serve in a tamper evident capacity by leaving a telltale sign that it has been removed, as would be the case with ingestible or personal care products, the relative ease with which this safety feature can be circumvented could have serious consequences for the consumer and the packager of the product. Consequently, a need still exists for an pull open tamper evident seal that overcomes the aforementioned deficiencies and drawbacks inherent in prior art pull open and non pull open induction seals.

It is in this context that the tamper evident pull open seal of my present invention assumes significance.

OBJECTS AND ADVANTAGES

It is the object of the present invention to overcome the drawbacks and disadvantages of both, prior art, pull open, and non pull open, induction seals by providing a single type of pull open tamper evident seal that can serve in multiple capacities. My seal invention achieves this objective by creating the pull opener from the central portion of the broken open seal itself, which allows the seal to be easily opened without the rim contact portion of the seal having to be removed from the container rim.

The seal is fabricated from a first layer of leak proof frangible sheet material that is bonded by a second adhesive layer to a third layer of strengthening sheet material. A fourth layer of adhesive bonds the strengthening layer side of the seal to the container rim. The strengthening layer together with the two adhesive layers contain a duplicate C shaped cut out void area that forms a breaking pattern which turns the strengthening layer into a break and tear template layer. When the frangible layer is bonded to the template layer, the missing material in the cut out void area of the breaking pattern creates a weakness in the multi layered seal only in the area of the C shaped breaking pattern configuration. Bonding the differing layers together in this arrangement produces a leak proof multi layered seal that is weaker only where just the first frangible layer covers over the cut out void area of the breaking pattern configuration in both the template layer and the adhesive layers.

When a consumer applies a specific amount of external pressure by forcing a finger into the installed seal, the weakness created in the multi layered seal by the cut out void area forces the seal to break open and tear only in the configuration of the C shaped breaking pattern that follows in close proximity the inside perimeter of the rim, while the rim contact portion of the seal remains bonded to the container rim. The frangible layer does not delaminate from the template layer during the opening procedure. The broken open C shaped central portion of the seal then forms a pull tab that can be accessed and pinched between a consumers fingers.

One or more portions of the C shaped breaking pattern configuration are left uncut to form one or more connectors that attach the broken open central portion of the seal forming the pull tab, to the rim contact portion of the seal that remains bonded to the container rim. The one or more connectors prevent the pull tab from completely breaking away from the rim contact portion of the seal and then being pushed into the container when the seal is broken open. The one or more connectors also leave all or a portion of the pull tab in a downward vertical position in the open mouth of the container which allows a consumer to position a finger under the tab, and then pull it back out. After being pulled back out the tab can be pinched and pulled.

Constructing the seal in this manner allows the central portion of the installed seal to be easily broken open without an opening device to reveal the pull tab, while the contact portion of the seal remains bonded to the container rim. The ability of the central portion of the seal to be opened to create the pull tab, while the contact portion of the seal remains bonded to the rim, allows the seal to be bonded to the rim with adhesives that possess different bonding characteristics. The ability of the seal to be bonded to the container rim using adhesives with differing bonding characteristics in turn, allows the seal to serve in different capacities.

In a first embodiment the object of the invention is to provide a leak proof pull open tamper evident induction seal that is highly resistant to being removed from the container without being destroyed in the process, thereby preventing its reattachment. In this first embodiment the seal invention leaves behind the rim contact portion of the seal to provide telltale evidence when the seal is broken open and removed which allows the seal to serve in a tamper evident capacity on containers of ingestible products such as food, health care products, or pharmaceuticals etc., where product safety is of paramount importance.

The ability of the seal to serve in this tamper evident capacity is achieved by bonding the seal to the container rim with a high strength micro encapsulated reactive type adhesive. Micro encapsulated adhesives are comprised of hollow spheres that can contain various types of single component or two or more part component adhesives such as resin and hardener. The seal can be bonded to the container rim by either melting the shell of the spheres with the induction sealing process or the shells can be broken by compression applied to the rim contact portion of the seal when the closure cap is installed. Breaking the shell of the spheres by either, compression, or by heat generated in the induction sealing process, initiates a curing reaction in the adhesive which bonds the seal to the container rim. When fully cured the hardened adhesive creates a high strength bond that prevents the seal from being able to be removed from the rim by force or by the action of solvents. Additionally, the cured reactive adhesive also prevents the seal from being able to be removed from the container rim by the reapplication of heat.

When the seal is broken open and the tab is pulled, the high strength bond of this type of adhesive forces the pull tab connector to tear from the rim contact portion of the seal and release the tab. The rim contact portion of the seal remains bonded to the rim to provide telltale evidence that the seal has been opened and removed. Additionally, various materials can be used for one or more of the seal layers that allow the contact portion of the seal that remains bonded to the rim to provide a leak proof hermetic seal between the container rim and the closure cap after the seal is broken open and removed and the cap is reinstalled. When a container that uses this tamper evident seal is opened with the seal intact, it provides a high degree of assurance to the consumer that the seal has not been previously removed and the contents adulterated.

Although using this type of adhesive prevents the container from being cleanly recycled unless the rim contact portion of the opened seal is forcibly scraped from the rim, the added benefits of enhanced product safety and the ability to hermetically reseal the container after opening far outweighs this inconvenience. If scraping off the contact portion of the seal is not possible for a consumer, the empty container can simply be discarded.

In a second embodiment the object of the invention is to provide a lower cost leak proof pull open tamper evident induction seal that is resistant to being removed from the container without being destroyed in the process, thereby preventing its reattachment. In this second embodiment the seal invention also leaves behind telltale evidence of its removal when the seal is broken open and removed which also allows the seal to serve in a tamper evident capacity on containers of ingestible products, or personal care products such as cosmetics, or skin cream etc. where product safety is also important.

The ability of the seal to serve in this tamper evident capacity is achieved by using a lower cost, heat activated, high strength, hot melt type adhesive to bond the seal to the container rim. Heat generated in the seal during the induction sealing process melts the hot melt adhesive layer which in turn bonds the seal to the rim. After cooling the adhesive creates a high strength bond that prevents the rim contact portion of the seal from being removed from the rim by force.

When the seal is broken open and the tab is pulled, the high strength bond of the hot melt adhesive forces the pull tab connector to tear from the rim contact portion of the seal and release the tab. The rim contact portion of the seal remains bonded to the rim to provide telltale evidence that the seal has been opened and removed. Additionally, various materials can be used for one or more of the seal layers that allow the contact portion of the seal that remains bonded to the rim to provide a leak proof hermetic seal between the container rim and the closure cap when the seal is broken open and removed and the cap is reinstalled.

Although using this type of adhesive allows the installed seal to be removed from the container intact by the reapplication of heat, the closure provides a low cost pull open leak proof tamper evident container seal that eliminates many of the drawbacks of the prior art pull open and non pull open tamper evident seals. When a container that uses this tamper evident seal is opened with the seal intact, it provides a degree of assurance to the consumer that the seal has not been previously removed and the contents adulterated.

Although using this type of adhesive also prevents the container from being cleanly recycled unless the contact portion of the opened seal is forcibly scraped from the rim, the added benefits of enhanced tamper resistance and the ability to hermetically reseal the container after opening far outweighs this inconvenience. If scraping off the contact portion of the seal is not possible for a consumer, the empty container can simply be discarded.

In a third embodiment the object of the invention is to provide a leak proof pull open tamper evident induction seal that is also resistant to being removed from the container without being destroyed in the process thereby preventing its reattachment. However, in this third embodiment the entire seal is completely removed from the container, including the rim contact portion, when the seal is broken open and the pull tab is pulled. This allows the seal to serve as a leak proof pull open tamper evident seal on containers of products where the ability to recycle the empty container without the container being contaminated by any of the broken open seal material is desirable.

The ability of the seal to serve in this capacity is achieved by using a heat activated hot melt adhesive with a bond strength that is stronger than the seal material in the area of the breaking pattern and, at the same time, weaker than the strength of the pull tab connector. When a consumer forces a finger into the installed seal, the adhesive is strong enough to maintain the bond between the seal and the container rim which forces the seal to break open and, at the same time, weak enough to allow the rim contact portion of the seal to be peeled off the container rim along with the pull tab when the tab is pulled. This allows the empty container to be cleanly recycled. Although using this type of adhesive again allows the installed seal to be removed from the container intact by the application of heat, the closure provides a low cost, pull open, leak proof, tamper evident container seal that can be used to seal containers of products such as household cleaners, garage products, or chemicals etc., where adulteration of the product would not be a critical concern.

In addition to achieving the objective of providing a pull open tamper evident induction seal that overcomes the disadvantages of prior art seals, my seal invention also provides additional advantages.

It is an additional object of the invention to provide a pull open tamper evident seal that eliminates the need for any additional pull members or peripheral tabs to form the pull opener.

It is a further object to provide a pull open tamper evident seal that efficiently creates the integral pull opener from the central portion of the material layers of the seal itself.

It is yet another object of the invention to provide a pull open tamper evident seal that can be used with or without additional liners.

It is a further object of the invention to provide a pull open tamper evident seal that easily breaks open in the configuration of a pull tab when a consumer forces a finger into the installed seal.

It is yet a further object of the invention to provide a single type of pull open tamper evident seal that can serve in different capacities by using different adhesives.

It is another object of the invention to provide a low cost pull open tamper evident seal that is economical to produce in a high speed manner using existing materials, manufacturing equipment, and methods that are familiar to those skilled in the art.

It is a additional object of the invention to provide a pull open tamper evident seal that is leak proof, adaptable to existing containers and closure caps and can be installed using existing installation methods and equipment.

It is a further object of the invention to provide a pull open tamper evident seal that can be opened without any the seal material contaminating the container contents.

It is an additional object of the invention to provide a pull open tamper evident seal that that can be bonded to the container rim by induction sealing or by the pressure brought to bear against the rim contact portion of the seal by the installation of the closure cap.

It is also an object of the invention to provide a pull open tamper evident seal that is impervious to the container contents and will maintain its integrity over an extended period of time on the shelf.

It is yet another object of the invention to provide a pull open tamper evident seal that allows the amount of finger pushing force necessary to initiate breaking of the seal to be precisely set.

These and other significant advantages of my pull open tamper evident seal invention can be more fully appreciated and understood by those skilled in the art with a detailed reading of the specification and an overview of the drawings contained herein.

SUMMARY OF THE INVENTION

The pull open tamper evident closure seal of the present invention is specifically concerned with the provision of effective means for sealing over the opening of rigid and semi rigid containers of the type used for storing and dispensing a wide variety of consumer and commercial products such as; ingestible products, food, health care products, personal care products, household products, or garage products and the like.

The principal advantages of the invention are achieved by constructing the seal from a first layer of leak proof frangible sheet material herein called the frangible layer. The first frangible layer is bonded by a second adhesive layer to a third layer of strengthening sheet material. A fourth adhesive layer bonds the seal to the container rim. The third strengthening layer together with the two adhesive layers each contain a duplicate C shaped cut out void configuration that turns the strengthening layer into a break and tear template herein called the template layer. Bonding the template layer to the frangible layer strengthens the frangible layer everywhere except in the area of the breaking pattern by leaving only the first frangible layer covering over the C shaped cut out void configuration of the breaking pattern which in turn creates a weakness in the multi layered seal only in the area of the C shaped breaking pattern.

When a consumer pushes a finger into the installed seal, the externally applied pressure forces the C shaped central portion of the seal to break open inwardly and tear only in the weaker area of the C shaped breaking pattern configuration that closely follows the inside perimeter of the container rim. The broken open C shaped central portion of the seal then forms a pull tab that can be lifted back out of the open mouth of the container by a consumers finger and then pinched and pulled. One or more uncut areas of the C shaped breaking pattern form one or more connectors that keep the pull tab attached to the rim contact portion of the seal that remains bonded to the container rim after the seal is broken open. This prevents the central portion of the seal forming the pull tab from breaking away from the rim contact portion of the seal and being completely pushed into the container when the seal is broken open.

Constructing the seal in this manner allows the central portion of the seal forming the pull tab to be easily broken open without the rim contact portion of the seal having to be removed from the container rim. This allows the seal to be bonded to the container rim with different types of adhesives. The ability to use different adhesives in turn allows the seal to serve in different capacities.

In a first embodiment the seal provides a high level of resistance to tampering by using a high strength reactive type adhesive to bond the seal to the container rim. The high strength adhesive cures after being heated during an induction sealing process or compressed by the closure cap which prevents the installed seal from being removed from the container without being destroyed in the process. Additionally the adhesive cannot be melted after the seal is installed which prevents the seal from being able to be removed and reinstalled by the application of heat. The high strength adhesive forces the pull tab connector to tear from the rim contact portion of the seal when the tab is pulled. The rim contact portion of the seal remains bonded to the container rim to provide evidence that the seal has been removed. The use of this type of adhesive prevents the surreptitious removal and replacement of the seal which significantly increases the difficulty of adulterating the container contents without leaving telltale evidence of such adulteration.

In a second embodiment the seal provides a high level of resistance to tampering by using a lower cost high strength heat activated hot melt type adhesive to bond the seal to the container rim. The high strength adhesive prevents the installed seal from being removed from the container without being destroyed in the process. The high strength adhesive also forces the pull tab connector to tear from the rim contact portion of the seal when the pull tab is pulled. The rim contact portion of the seal remains bonded to the container rim to provide evidence that the seal has been removed. Although the use of this hot melt type adhesive does not prevent the seal from being removed from the container intact by the application of heat, the seal provides a low cost leak proof pull open tamper evident container closure that eliminates many of the drawbacks associated with existing pull open tamper evident seals.

In a third embodiment the seal uses a low strength heat activated hot melt type adhesive to bond the seal to the container rim. The adhesive has a bond strength that is greater than the breaking strength of the seal and, at the same time, less than the strength of the pull tab connector. This allows the rim contact portion of the seal to peel off the container rim along with the tab when the seal is broken open and the pull tab is pulled. The ability of the adhesive to release the contact portion of the seal allows the container to be cleanly recycled.

The principal feature of the invention is to provide a leak proof pull open seal that eliminates the disadvantages inherent in prior art pull open and non pull open container seals that serve in either a tamper evident or non tamper evident capacity by providing a single type of pull open seal that can serve in all these capacities. Additionally the invention creates the integral pull opener from the central portion of the seal itself which eliminates the need for any external pull tabs or pull members which allows the seal to be easily opened without the use a of an opening tool. The seal can be bonded to a container rim using a variety of methods such as induction sealing, contact sealing, pressure sealing, heat sealing, or ultrasonic sealing etc.

BRIEF DESCRIPTION OF THE DRAWINGS

FIG. 4 A illustrates a sectional view of the seal invention showing the differing individual layers bonded together.

FIG. 12 A illustrates a sectional view of the seal invention together with the additional layers of material inserted into the closure cap that allow the seal invention to be installed by using the induction sealing process.

REFERENCE NUMERALS IN DRAWINGS

Figure 1:
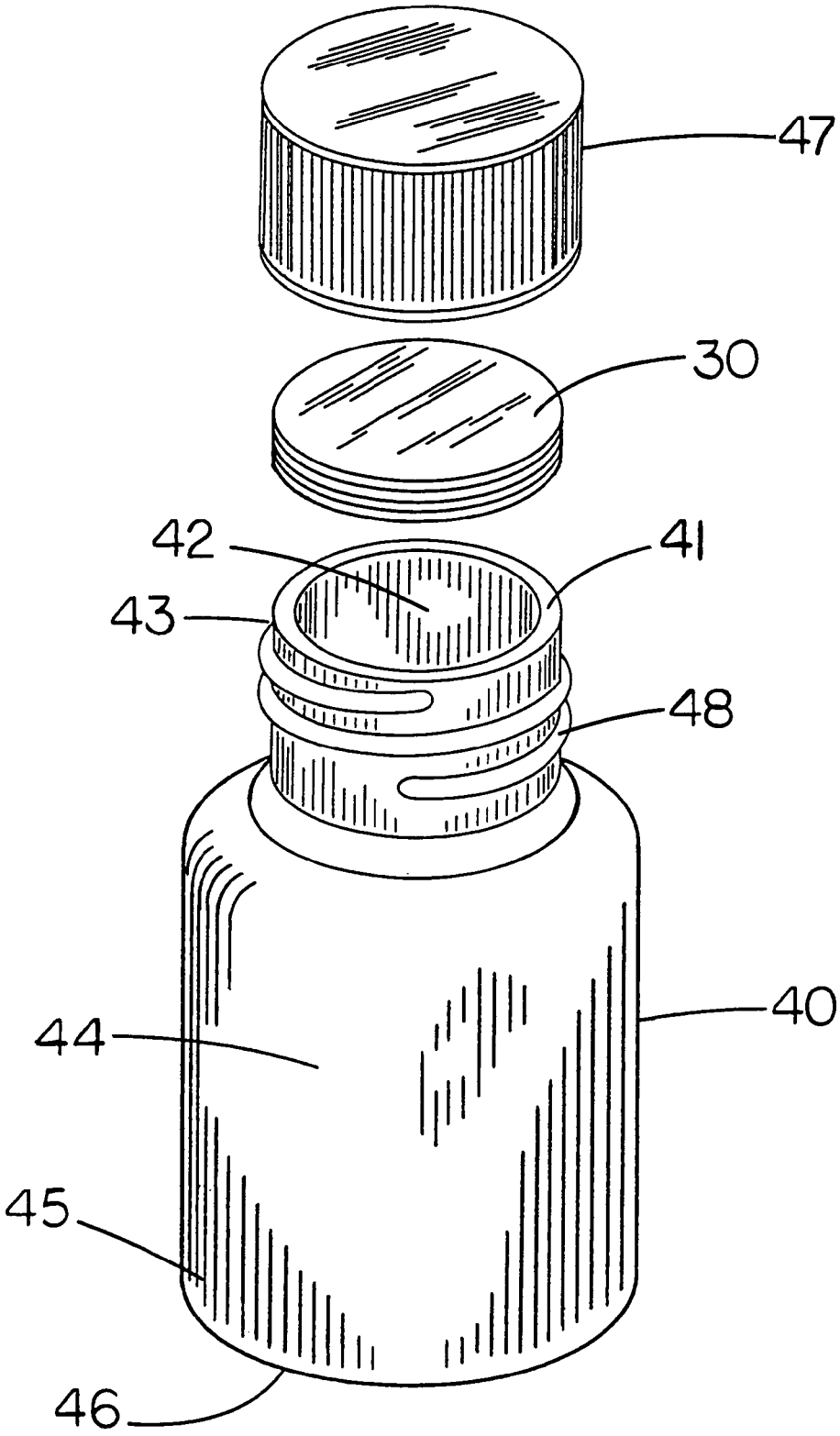
FIG. 1 illustrates a perspective view of the tamper evident pull open multi layered seal invention together with a conventional container and closure cap.

30. Seal
31. Frangible layer
32. Adhesive layer
33. Template layer
34. Adhesive layer
35A. Breaking pattern
36. Inner upper surface area of closure cap
37. Uncut area forming connector
38. Pull tab
39. Peripheral rim contact portion
40. Container
41. Container rim
42. Container mouth
43. Container top end
44. Container body portion
45. Container bottom end
46. Container bottom wall end
47. Closure cap
48. Screw threads
49. Strip
50. Absorptive material layer
51. Releasable adhesive layer

DETAILED DESCRIPTION OF THE PREFERRED EMBODIMENTS

With reference to drawing FIG. 1, there is shown a perspective view of a tamper evident frangible container seal 30 with an integral pull opener 38 constructed in accordance with the present invention. Seal 30 provides a leak proof pull open closure for a plurality of open mouth containers 40 of the type typically used for the storage and dispensing of a wide variety of products such as; ingestible products; food; health care products; personal care products; cleaners; household products; garage products; or commercial and industrial products etc. As further shown in FIG. 1, container 40 is comprised of a tubular body portion 44 with a bottom end 45 sealed by an integral wall end 46 and an opposite top end 43 forming a open mouth 42 that ends with an exterior rim 41 that provides a surface area for bonding seal 30 over container 40 mouth opening 42. A closure cap 47 may also be provided for installation over open mouth 42 sealed with seal 30. These types of containers 40 and caps 47 can be constructed from one or more different types of material such as; plastic, glass, paper board, or metal.

Figure 2:
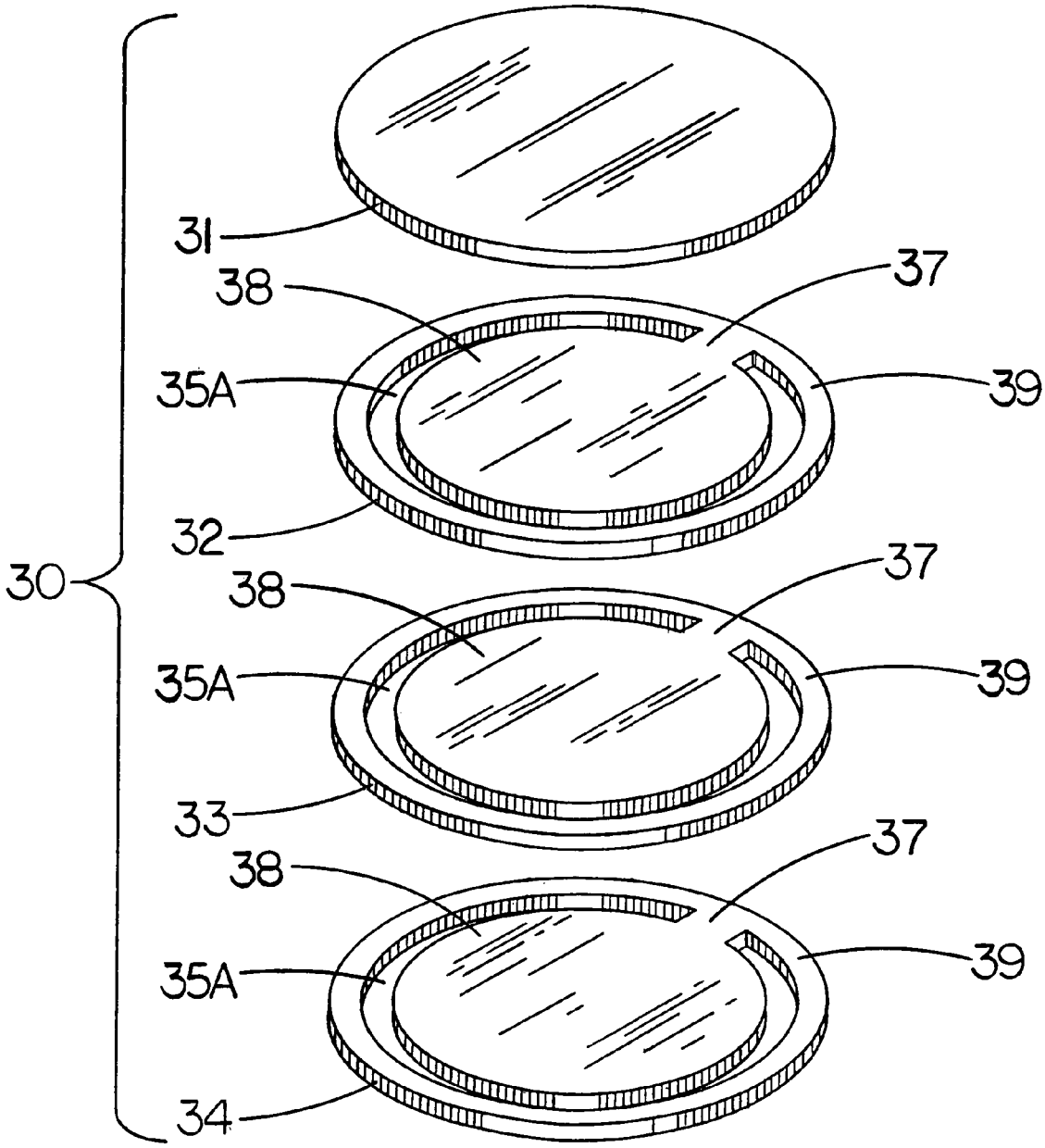
FIG. 2 illustrates an exploded view of the seal invention showing the structural function of the differing individual layers.
Figure 3:
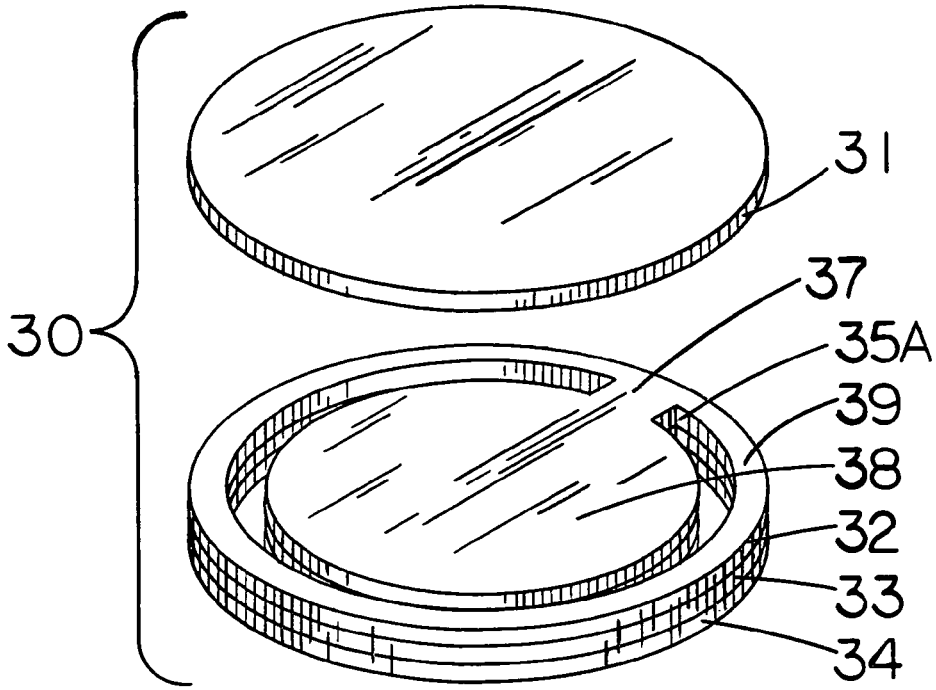
FIG. 3 illustrates a partially exploded view of the seal invention showing the structural function of the differing individual layers.

Now looking at the exploded view of FIG. 2 and the partially exploded view of FIG. 3, seal 30 is constructed from a first layer 31 of leak proof frangible sheet material that is comprised of one or more layers of either; metal foil; polymers; plastic; synthetic foam; paper; adhesive; or combinations thereof, and is herein referred to as frangible layer 31. Frangible layer 31 is bonded by a second layer 32 of material comprised of one or more layers of adhesive, and herein referred to as adhesive layer 32, to a third layer 33 of sheet material comprised of one or more layers of either; metal foil; polymers; plastic; synthetic foam; paper; adhesive; or combinations thereof, and is herein referred to as template layer 33. A fourth layer 34 of material comprised of one or more layers of adhesive and herein referred to as adhesive layer 34, bonds seal 30 to container 40 rim 41. Different types of adhesives may be used for adhesive layer 34 that allow seal 30 to be bonded to container 40 rim 41 by various means known to those skilled in the art such as; heat; reactive; evaporative; compression; pressure sensitive; fusion; ultrasonic; or induction sealing.

As further shown in the exploded view of FIG. 2 and the partially exploded view of FIG. 3, template layer 33, together with adhesive layers 32 and 34 respectively, each contain a duplicate C shaped cut out void configuration and is herein referred to as breaking pattern 35A. The C shaped configuration of breaking pattern 35A forms a pull tab 38 from the central portion of template layer 33 together with adhesive layers 32 and 34 respectively. Cutting the C shaped breaking pattern 35A configuration into template layer 33 turns template layer 33, together with adhesive layers 32 and 34, into a break and tear template.

Figure 4:
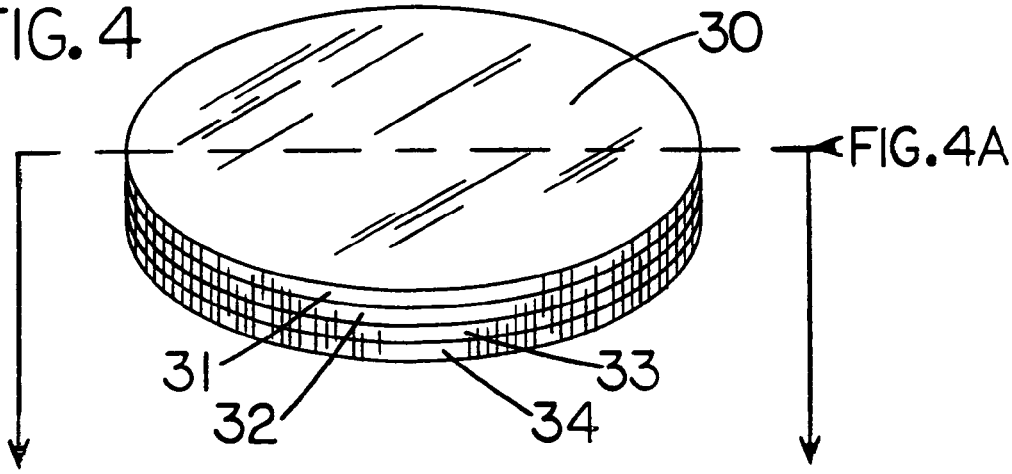
FIG. 4 illustrates a perspective view of the seal invention showing the differing individual layers bonded together.
Figure 4A:
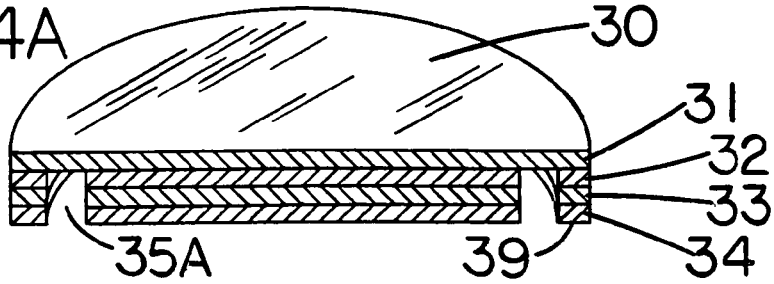

As shown in the perspective view of FIG. 4, frangible layer 31 is then bonded to template layer 33 and adhesive layer 34 by adhesive layer 32 to form the leak proof seal 30 invention that is comprised of multiple layers everywhere except in the area of breaking pattern 35A, where seal 30 is comprised of only the single frangible layer 31 that must be broken to break open seal 30, as further shown in the sectional view of FIG. 4A.

Figure 5:
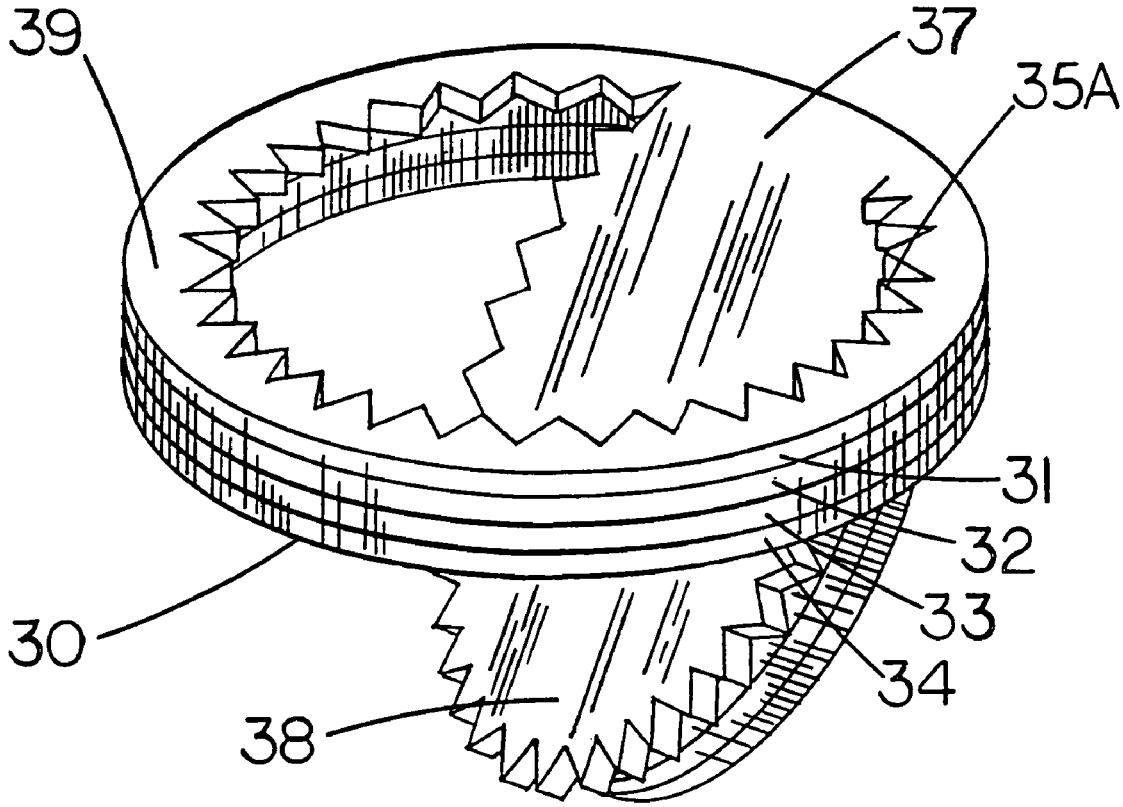
FIG. 5 illustrates a perspective view of the uninstalled seal invention in a broken open condition.

As shown in the perspective view of FIG. 5, this differing multi layered construction leaves seal 30 relatively weaker only in the area where the single frangible layer 31 covers over the cut out void configuration of breaking pattern 35A which forms pull tab 38, while making the remaining multi layered area of seal 30 relatively stronger, which forces seal 30 to break open when a set amount of external pressure is applied to seal 30.

Figure 6:
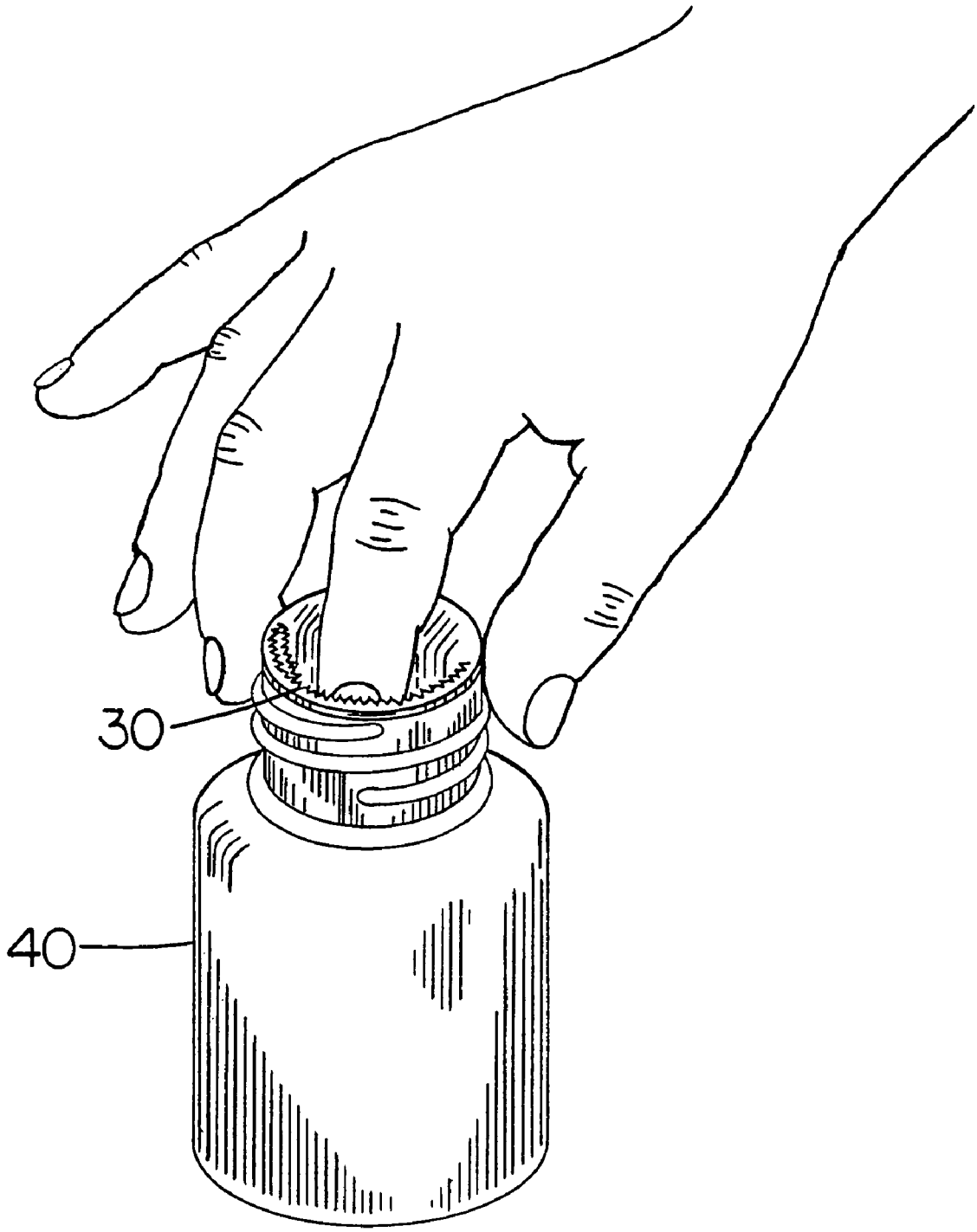
FIG. 6 illustrates a perspective view of the seal invention being broken open inwardly by a consumer forcing a finger into the seal when installed on a conventional container.
Figure 7:
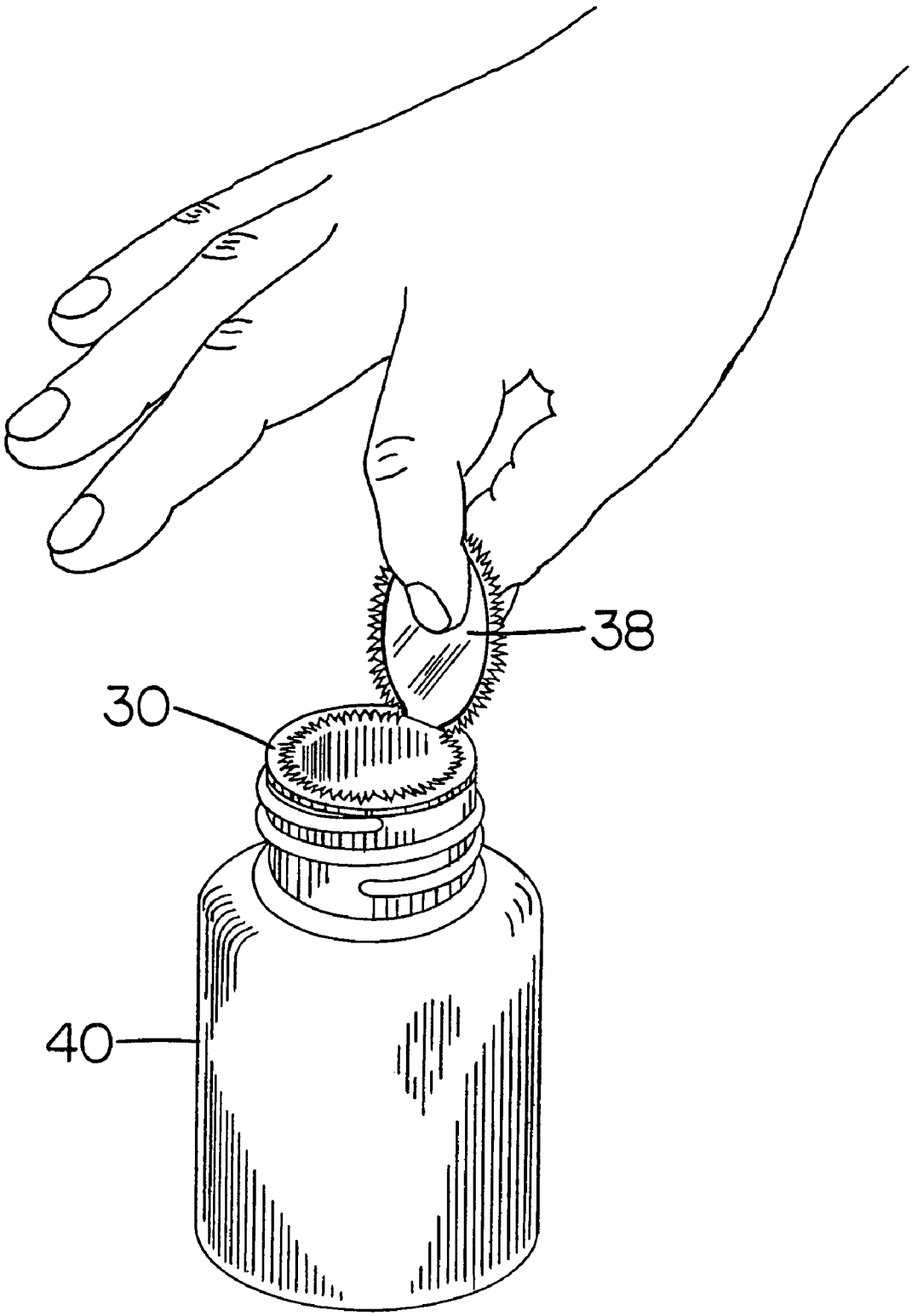
FIG. 7 illustrates a perspective view of the broken open central portion of the seal invention forming a pull tab that can be pinched by a consumer after being lifted out of the container mouth.

As shown in the perspective view of FIG. 6, when a certain amount of external pressure is applied to the installed seal 30 by a consumer applying increasing finger pushing force, the stronger area-weaker area structure of seal 30 forces seal 30 to break open inwardly and tear only in the weaker single frangible layered 31 area of the C shaped breaking pattern 35A configuration As further shown in FIG. 6, when the broken open seal 30 is pushed further into container 40 mouth opening 42, the weakness created in seal 30 by breaking pattern 35A forces seal 30 to tear only in the C shaped configuration of breaking pattern 35A which follows in close proximity the inside perimeter of rim 41 thereby creating pull tab 38 from the central portion of seal 30 itself.

As further shown in FIGS. 2, 3, 5, 7, 9, 13, and 14, a portion of the C shaped breaking pattern 35A configuration is left uncut to form connector 37. Connector 37 serves a two fold purpose. First, when seal 30 is broken open, connector 37 prevents pull tab 38 from tearing away from rim contact portion 39 of seal 30 that remains bonded to rim 41 and then being completely pushed into container 40 and contaminating container 40 contents. Secondly, after seal 30 is broken open, connector 37 also keeps pull tab 38 in a downward vertical position inside container 40 mouth opening 42.

As further shown in the perspective view of FIG. 6, the ability of connector 37 to hold pull tab 38 in a vertical position just inside mouth opening 42 after seal 30 is broken open, allows pull tab 38 to be easily accessed and lifted back out by a consumers finger. After pull tab 38 is lifted back of container 40 mouth opening 42, it can pinched between a consumers finger and thumb which allows pull tab 38 to be pulled as further shown in FIG. 7.

The differing multi layered construction of 30 seal allows seal 30 to be easily broken open to reveal pull tab 38 without rim contact portion 39 of seal 30 having to be removed from container 40 rim 41. The ability of seal 30 to be broken open inwardly by a consumer applying finger pushing force against seal 30 to reveal pull tab 38 while rim contact portion 39 of seal 30 remains bonded to rim 41, allows seal 30 to be bonded to rim 41 with adhesives that possess different bonding characteristics. The ability to bond seal 30 to rim 41 with adhesives that possess different bonding characteristics in turn allows seal 30 to serve in different capacities.

In a first embodiment, seal 30 provides a leak proof, pull open, tamper evident closure seal 30 that is highly resistant to being removed from container 40 rim 41 without being destroyed in the process, thereby preventing its reattachment. In this first embodiment, adhesive layer 34 is comprised of a high strength adhesive.

Figure 8:
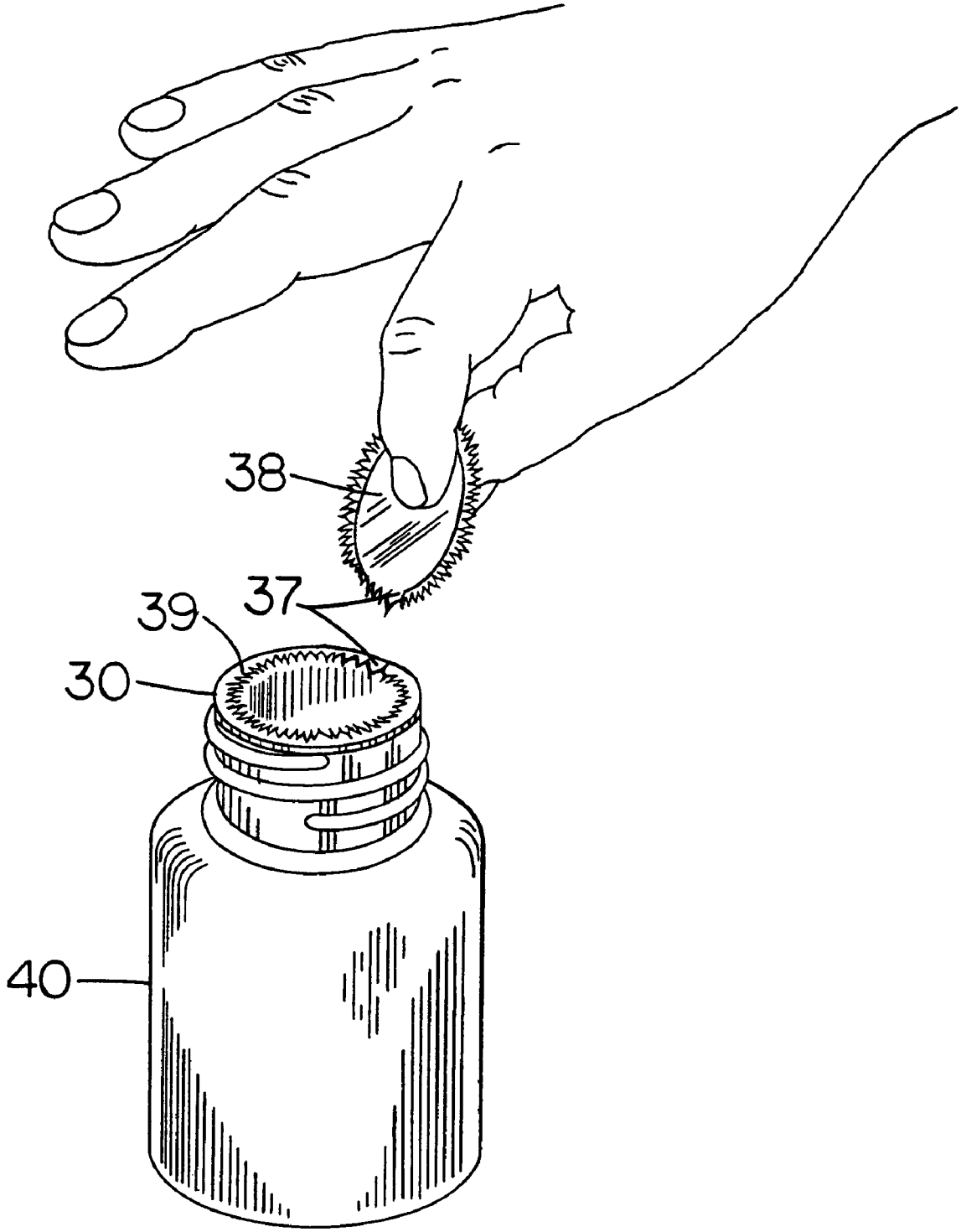
FIG. 8 illustrates a perspective view of the broken open central portion of the seal invention forming the pull tab being pulled and torn from the rim contact portion of the seal that remains bonded to the container rim.

As shown in the perspective view of FIG. 8, when seal 30 is broken open and pull tab 38 is pulled, the high strength bond of adhesive layer 34 forces connector 37 to tear and release pull tab 38 from rim contact portion 39 of seal 30. Rim contact portion 39 of seal 30 remains bonded to rim 41 to provide telltale evidence that seal 30 has been opened and removed.

In this first embodiment adhesive layer 34 is comprised of a high strength, microencapsulated, reactive type adhesive to bond seal 30 to container 40 rim 41. Micro encapsulated adhesives are comprised of hollow spheres that can contain various types of single component, or two component adhesives such as resin and hardener. Seal 30 can be bonded to container 40 rim 41 by either melting the shell of the spheres during an induction sealing process, or the shells can be broken by the compression applied to rim contact portion 39 of seal 30 when closure cap 47 is installed. When the shell of the spheres are melted by heat or broken by compression, either a single component adhesive, or a two component adhesive that combines to initiate a curing reaction, bonds seal 30 to the container 40 rim 41. When fully dried or cured, hardened adhesive layer 34 creates a high strength bond that prevents rim contact portion 39 of seal 40 from being removed from rim 41 by force, or by the action of solvents. Additionally, reactive adhesive layer 34 also prevents seal 30 from being able to be removed from container 40 rim 41 by the reapplication of heat. This allows seal 30 to serve in a tamper evident capacity on containers 40 of ingestible products such as food, or health care products etc. where product purity is of paramount importance.

This type of adhesive can be applied to sheet material by spraying, rolling, or thin film application. After being applied, the adhesive dries to touch to form adhesive layer 34. Reactive adhesives of this type are commercially available from a number of manufacturers such the R. T. Dodge Co. of Centerville Oh.

Additionally, one or more layers of sheet material can be used for either frangible layer 31, template layer 33, or both, that allow rim contact portion 39 of seal 30 to also function as a leak proof hermetic seal between rim 41 and closure cap 47 after seal 30 is broken open and pull tab 38 is removed.

Although using this type of reactive adhesive prevents container 40 from being cleanly recycled unless rim contact portion 39 of seal 30 is forcibly scraped from rim 41, the added benefits of enhanced product safety and the ability to hermetically reseal container 40 after opening far outweighs this inconvenience. If scraping off rim contact portion 39 of seal 30 is not possible for a consumer, the empty container 40 can simply be discarded.

In a second embodiment seal 30 provides a leak proof, pull open, tamper evident closure seal 30 that is also resistant to being removed from container 40 rim 41 without being destroyed in the process, thereby preventing its reattachment. In this second embodiment, adhesive layer 34 is comprised of a second type of high strength adhesive.

As again shown in the perspective view of FIG. 8, when seal 30 is broken open and pull tab 38 is pulled, the high strength bond of adhesive layer 34 forces connector 37 to tear and release pull tab 38 from rim contact portion 39 of seal 30. Rim contact portion 39 of seal 30 remains bonded to rim 41 to provide telltale evidence that seal 30 has been opened and removed.

In this second embodiment adhesive layer 34 is comprised of a heat activated, high strength, hot melt type adhesive to bond seal 30 to container 40 rim 41. Heat generated in seal 30 during the installation process melts adhesive layer 34 which after cooling, bonds seal 30 to container 40 rim 41. When cooled, adhesive layer 34 creates a high strength bond that makes rim contact portion 39 of seal 30 resistant to surreptitious removal from rim 41 by force or by the action of solvents.

Although the use of this type of adhesive does not prevent seal 30 from being removed from rim 41 intact, and then replaced by the application of heat, it does provide a lower cost, tamper evident, pull open, leak proof seal 30 that can be used to seal containers 40 of ingestible and non ingestible products such as cosmetics, or skin cream etc. where product safety is also important.

Hot melt adhesives suitable for this purpose are widely used throughout the packaging industry and cost substantially less than reactive type adhesives, and when used in this capacity provide a lower cost seal 30. Hot melt adhesives of this type are commercially available from a number of manufacturers such as the Ellsworth Corp. of Woburn Ma.

Additionally, one or more layers of sheet material can be used for either frangible layer 31, template layer 33, or both, that allow rim contact portion 39 of seal 30 to also function as a leak proof hermetic seal between rim 41 and closure cap 47 when seal 30 is broken open and pull tab 38 is removed.

Although using this type of hot melt adhesive prevents container 40 from being cleanly recycled unless rim contact portion 39 of seal 30 is forcibly scraped from rim 41, the added benefits of enhanced product safety and the ability to hermetically reseal container 40 after opening far outweighs this inconvenience. If scraping off rim contact portion 39 of seal 30 is not possible for a consumer, empty container 40 can simply be discarded.

In a third embodiment, seal 30 provides a leak proof, pull open, tamper evident closure seal 30 that is also resistant to being removed from container 40 rim 42 without being destroyed in the process, thereby preventing its reattachment. In this third embodiment adhesive layer 34 is comprised of a low strength adhesive.

Figure 9:
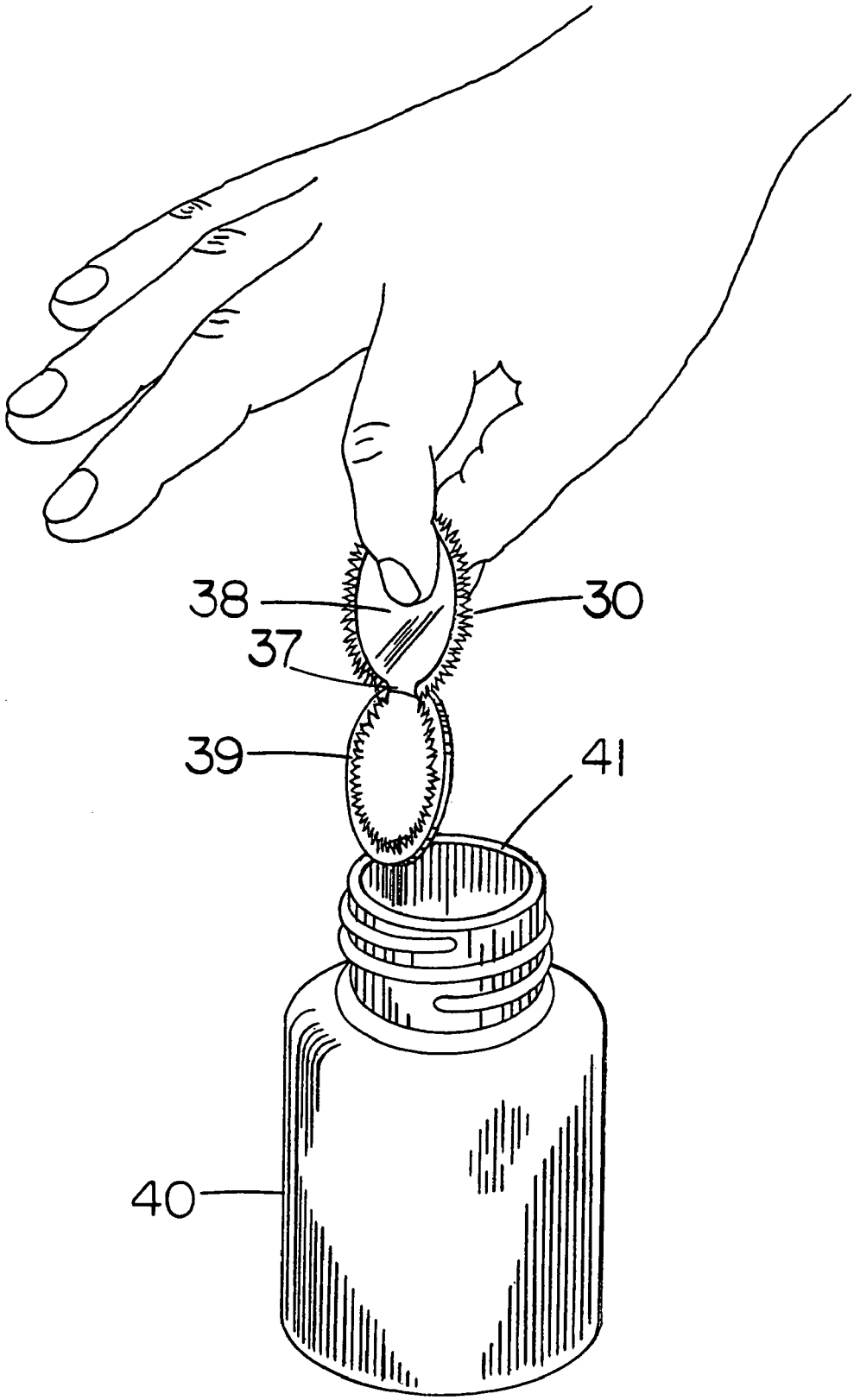
FIG. 9 illustrates a perspective view of the rim contact portion of the seal invention being pulled from the container rim together with the central portion of the seal forming the pull tab when the seal is broken open and the pull tab is pulled.

As shown in the perspective view of FIG. 9, when seal 30 is broken open and pull tab 38 is pulled, the low strength of adhesive layer 34 allows rim contact portion 39 of seal 30 to peel off container 40 rim 41 together with pull tab 38 when pull tab 38 is pulled.

In this third embodiment, adhesive layer 34 is comprised of a heat activated, low strength, hot melt type adhesive to bond seal 30 to container 40 rim 41. Heat generated in seal 30 during the installation process melts adhesive layer 34, which after cooling, bonds seal 30 to container 40 rim 41. When cooled, adhesive layer 34 creates a low strength bond that is stronger than the strength of seal 30 in the area of breaking pattern 35A and, at the same time, weaker than the strength of pull tab 38 connector 37. When seal 30 is broken open and pull tab 38 is pulled, the low strength bond of adhesive layer 34 allows rim contact portion 39 of seal 30 to peel off container 40 rim 41 along with pull tab 38. Rim contact portion 39 remains attached to pull tab 38 which allows all of seal 30 to be completely removed from container 40 when pull tab 38 is pulled as further shown in FIG. 9.

Although using this weaker type of heat activated adhesive does not provide the same level of tamper resistance as the stronger adhesives serving in the first and second embodiments, it does allow seal 30 to serve in a tamper evident capacity by causing the destruction of seal 30 during the opening procedure while also providing a leak proof pull open seal 30 that can be completely removed from container 40 without the use of an opening tool. This allows seal 30 to be used on contained products where adulteration of the contents are not a critical factor such as household, or garage products etc., and where the ability to easily recycle container 40 without any of seal 30 material contaminating container 40, is desirable.

Hot melt adhesives suitable for this purpose are widely used throughout the packaging industry and are commercially available from a number of manufacturers such as 3 M Corp. of St. Paul Mn.

Figure 10:
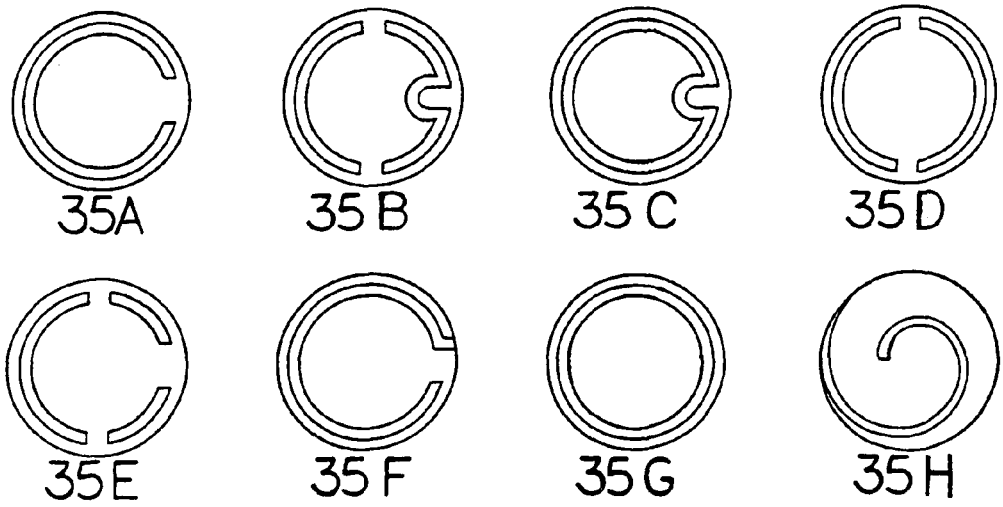
FIG. 10 illustrates a plurality of different breaking pattern configurations that may be used to form the pull tab.

In addition to showing the configuration of breaking pattern 35A, FIG. 10 also illustrates a plurality of additional breaking pattern configurations 35B thru 35H, that may also be used for template layer 33. The configuration of breaking pattern 35A of seal 30, as shown in FIGS. 2, 3, 5, 6, 7, 8, 9, 10, 11, 13, and 14, is used to illustrate the function of seal 30 invention and not to limit the embodiments disclosed herein to any specific configuration that can be adopted that will also allow seal 30 to function as intended.

Figure 11:
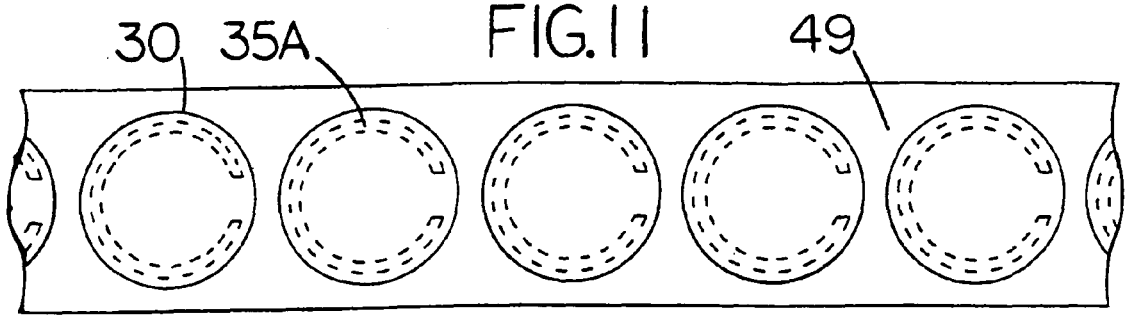
FIG. 11 illustrates a continuous strip of the multi layered seal material with hidden repeating breaking pattern configurations that are centered within the outline of the seal disk prior to being cut.

As shown in the hidden view of FIG. 11, seal 30, shown by outline, can be fabricated by cutting repeating spaced breaking pattern 35A configurations and if necessary, position indicators, into a continuous rolled strip 49 of template layer 33 sheet material that has either none, one, or both adhesive layers 32 and 34 already applied which allows duplicate breaking pattern 35A configurations to be cut into template layer 33 and either; none, one, or both adhesive layers 32 and 34 in a single step, or, after repeating spaced breaking pattern 35A configurations are cut into template layer 33, either one or both adhesive layers 32 and 34 can then be applied to template layer 33 material by various means known to those skilled in the art such as; spraying, rolling, or thin film application. In either process there is no adhesive spanning the cut out void area of the repeating breaking pattern 35A configurations. A continuous rolled strip of frangible layer 31 material and template layer 33 material with adhesive layers 32 and 34 applied are then roll bonded together by adhesive layer 32 without any adhesive being present in the void area of the repeating breaking pattern 35A configurations. This fabrication process produces a continuous roll of finished seal 30 material that leaves only single frangible layer 31 covering over the cut out void areas of the repeating spaced breaking pattern 35A configurations. The previously cut positioning indicators, or other positioning means, allow finished seal 30 disks to be cut from the continuous roll of multi layered seal 30 material in a high speed manner producing a finished seal 30 disk with breaking pattern 35A centered within seal 30 disk.

Figure 12:
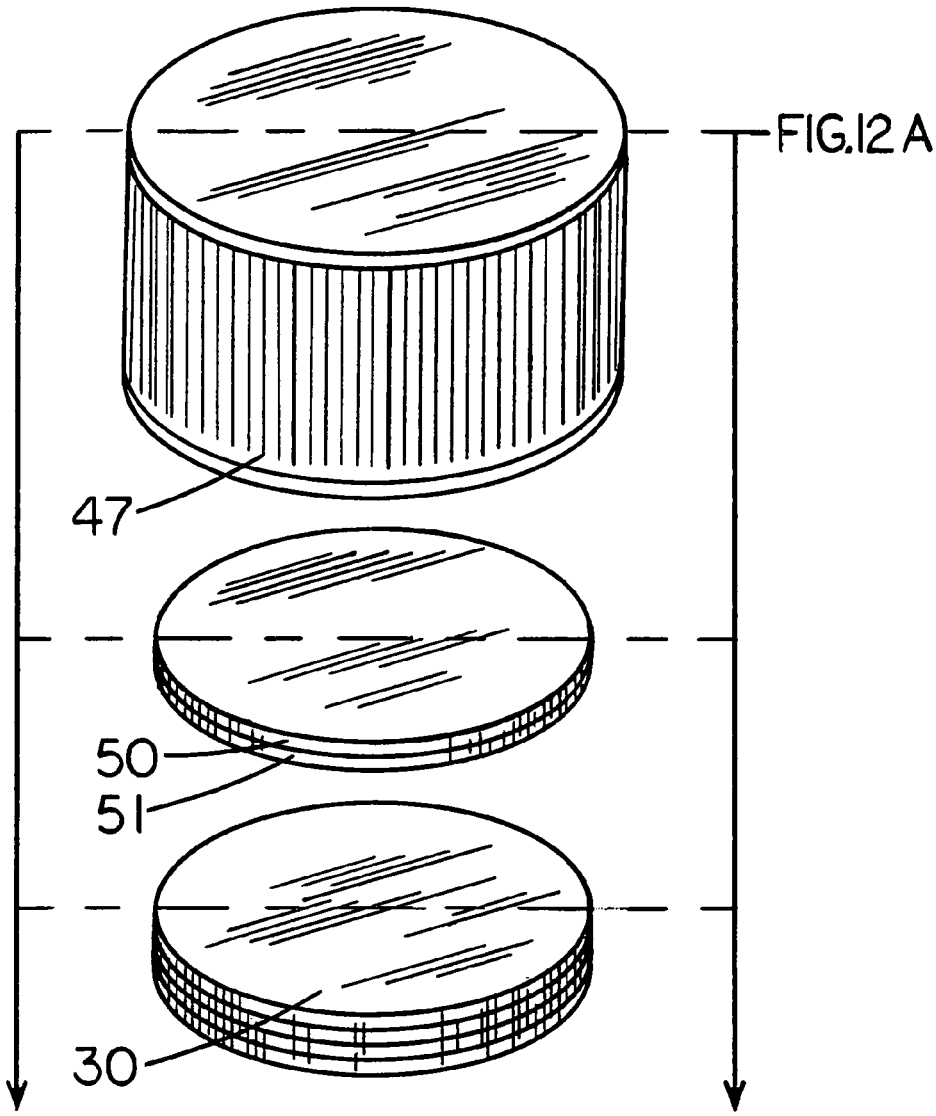
FIG. 12 illustrates an exploded view of the seal invention together with a closure cap and additional layers of material that allow the seal invention to be inserted into the closure cap as a single multi layered disk and installed by using the induction sealing process.
Figure 12A:
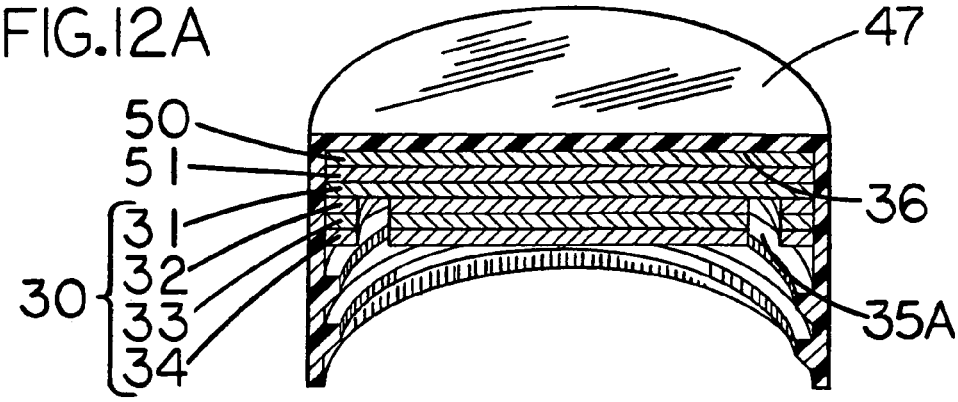

As shown in the perspective view of FIG. 12 and the sectional view of FIG. 12A, seal 30 can also include one or more additional material layers, 50 and 51, that provide means for bonding seal 30 to container 40 rim 41 by induction heat sealing. A first layer of absorptive material 50 from a continuous roll is bonded to a continuous roll of the completed multi layered seal 30 material, as shown in FIG. 11, by a second layer of heat releasable adhesive 51 that is applied to frangible layer 31 side of seal 30. The previously cut positioning indicators, or other positioning means, allow the completed roll that contains repeating seal 30 breaking pattern 35A configurations now bonded to absorptive layer 50 by releasable adhesive layer 51, to be cut from the continuous roll of the completed multi layered seal 30 material in a high speed manner producing a finished seal 30 disk with breaking pattern 35A centered within seal 30 disk.

The completed multi layered induction seal 30 disk can then be bonded to container 40 rim 41 using the standard induction sealing system by inserting seal 30 disk into closure cap 47 which is then installed over container 40 mouth opening 42. This presses adhesive layer 34 side of seal 30 against container 40 rim 41. Container 40 is then passed through an induction sealer which heats seal 30. The generated heat in turn melts adhesive layer 34 which bonds seal 30 to container 40 rim 41 and simultaneously melts releasable adhesive layer 51 which is then absorbed into absorptive layer 50 thereby releasing seal 30. When closure cap 47 is removed from container 40, absorptive layer 50 disk is retained in cap 47 leaving only seal 30 bonded to container 40 rim 41.

Alternately seal 30 may also be inserted into closure cap 47 and installed on container 40 rim 41 using the induction sealing process without the use of any additional material layers.

The use of a separate frangible layer 31 to create the thinned area of breaking pattern 35A of seal 30 allows the amount of external pushing pressure required for a consumer to comfortably break open seal 30 to be set precisely. The pressure required to break open seal 30 when bonded over mouth opening 42 of container 40 can be adjusted by; increasing or decreasing the thickness of the material used in frangible layer 31; by the choice of material used in frangible layer 31; by the configuration of the breaking pattern used in template layer 33; or combinations of one or more of these.

Template layer 33 side of seal 30 may be bonded to container 40 rim 41 by adhesive layer 34, as described herein, or alternately, frangible layer 31 side of seal 30 may also be bonded to container 40 rim 41 by applying adhesive of a type previously described herein to frangible layer 31 that does not extend over the area of breaking pattern 35A, or the adhesive can be applied to rim 41 of container 40 itself.

Figure 13:
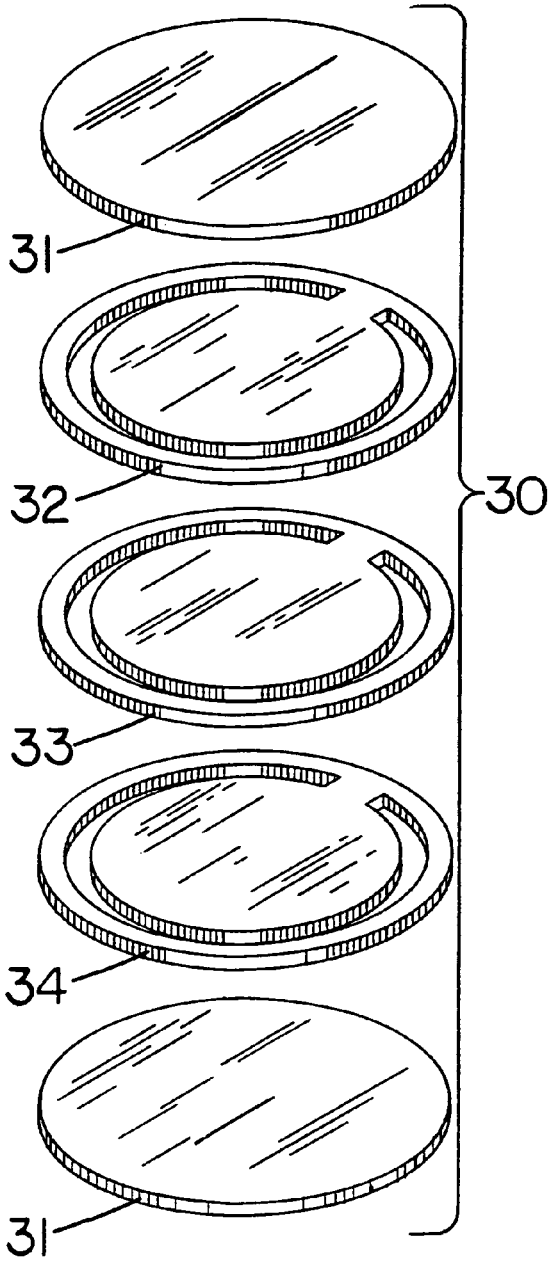
FIG. 13 illustrates an exploded view of an additional embodiment of the seal invention showing the structural function of the individual layers.

FIG. 13 illustrates an exploded view of an additional embodiment of seal 30 showing frangible layer 31 bonded to template layer 33 by adhesive layer 32 with a second frangible layer 31 bonded to the opposite side of template layer 33 by adhesive layer 34. Seal 30 can then be bonded to container 40 rim 41 by applying adhesive of a type previously described herein to either side of seal 30 that does not extend over the area of breaking pattern 35A, or the adhesive can be applied to rim 41 of container 40 itself.

Figure 14:
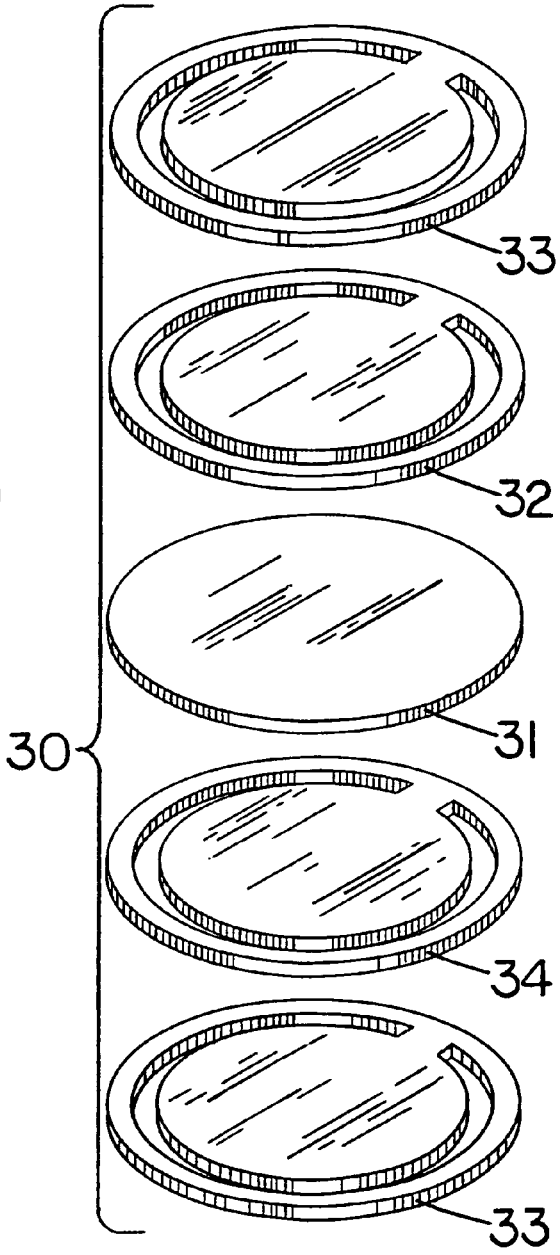
FIG. 14 illustrates an exploded view of another embodiment of the seal invention showing the structural function of the individual layers.

FIG. 14 illustrates an exploded view of another embodiment of seal 30 showing a first template layer 33 bonded to frangible layer 31 by adhesive layer 32 with a second template layer 33 bonded to the opposite side of frangible layer 31 by adhesive layer 34. Seal 30 can then be bonded to container 40 rim 41 by applying adhesive of a type previously disclosed herein to either side of seal 30 that does not extend over the area of breaking pattern 35A, or the adhesive can be applied to rim 41 of container 40 itself.

Adhesive layers 32 and 34 may be comprised of one or more layers of different types of adhesives such as; hot melt adhesives of the same or differing bonding temperatures; one or more part micro encapsulated adhesives; reactive adhesives; evaporative adhesives; or pressure sensitive adhesives that may incorporate an additional protective peel off layer that is removed before or after breaking pattern 35A is cut into adhesive layer 32, template layer 33, and adhesive layer 34 in a single step, allowing frangible layer 31 to be then applied to template layer 33 by pressure.

Adhesive layer 34 can be eliminated when either; seal 30 is to be bonded to container 40 rim 41 by the application of adhesive of a type previously describer herein to rim 41 of container 40 itself, or frangible layer 31 side of seal 30 is to be bonded to container 40 rim 41.

Adhesive layer 32 can be eliminated when frangible layer 31 is bonded directly to template layer 33 by various means known to those skilled in the art such as cladding or fusion bonding and the like.

When template layer 33 is comprised of adhesive, adhesive layer 32, template layer 33, and adhesive layer 34 can be combined and applied to frangible layer 31 in a single process. When the combined layers of adhesive are applied to frangible layer 31, breaking pattern 35A is formed by leaving an area in the configuration of breaking pattern 35A uncoated. This leaves the surface area of the multi layered seal 30 relatively weaker only in the uncoated area of single frangible layer 31 while making the multi layered coated area of seal 30 relatively stronger which forces seal 30, when bonded to container 40 rim 41, to break open and tear only in the single weaker frangible layer 31 area of breaking pattern 35A configuration.

As further shown in the sectional view of FIG. 12A, the inner upper planar surface area 36 of closure cap 47 is substantially flat and when secured to container 40 in a closed position, is held flat against the outer surface of seal 30 and, if present, any additional layers of material, 50 and 51, preventing seal 30 from breaking open prior to the removal of closure cap 47.

The size and shape of container 40 as shown in FIGS. 1, 6, 7, 8, and 9, is used as an example to illustrate the function of seal 30 rather than to limit the application of the embodiments of seal 30 to a container of a particular size or shape.

Closure cap 47 can be secured to container 40 by the use of complimentary screw threads 48 as shown in FIGS. 1, 6, 7, 8, and 9, or cap 47 may be attached by various other means such as pressure fitting.

Although the present invention has been described in terms of specific embodiments thereof, the invention claimed is not so restricted. It will be apparent to those skilled in the art that it is possible to modify and alter features of the invention while remaining within the spirit and scope of the inventive concept. Variations of the embodiments may be made without departing from the invention in its broader aspects such as; various other configurations not shown in the drawings may also be used for the breaking pattern; various other materials not disclosed in the specification may be used for frangible layer 31 or template layer 33; various other adhesives not disclosed in the specification may be used for adhesive layer 32 or adhesive layer 34; the construction of container 40 may vary from the illustrations shown in the drawings; seal 30 may be bonded to container 40 rim 41 by various other means not disclosed in the specification; the contents of container 40 may vary from those disclosed in the specification; any number of additional alternating frangible 31 or template 33 layers may also be bonded to either side of the multi layered seal 30 invention etc. Thus the scope of the invention should be determined by the appended claims and their legal equivalents, rather than by the examples given.

I claim:

1. A combination comprising a container comprised of a tubular body portion with a sealed bottom end and an opposite open top end ending with an exterior rim surrounding an access opening and providing a bonding surface for a seal, a tamper evident container seal with an integral pull opener for sealing over the access opening of said container; and a closure cap for securing to said container for covering over said seal and said access opening;

said seal comprising:

(a) a first layer of frangible sheet material, a second layer of adhesive, a third layer of strengthening sheet material, and a fourth layer of adhesive;

(b) wherein said second layer of adhesive, said third layer of strengthening sheet material and said fourth layer of adhesive each contain a breakable configuration of either a varied, C shaped, O shaped, segmented O shaped, or spiral shaped cut voids;

(c) wherein said breakable configuration of either a varied, C shaped, O shaped, segmented O shaped, or spiral shaped cut voids in said second layer of adhesive, said third layer of strengthening sheet material, and said fourth layer of adhesive are duplicates of each other;

(d) wherein said first layer of frangible sheet material, said second layer of adhesive, said third layer of strengthening sheet material, and said fourth layer of adhesive are bonded together forming said seal;

(e) wherein said breakable configuration of either a varied, C shaped, O shaped, segmented O shaped, or spiral shaped cut voids in said second layer of adhesive, said third layer of strengthening sheet material and said fourth layer of adhesive are in alignment with each other;

(f) wherein said breakable configuration of either a varied, C shaped, O shaped, segmented O shaped, or spiral shaped cut voids create one or more weak areas in said seal by leaving only said first layer of frangible sheet material covering over said breakable configuration of either a varied, C shaped, O shaped, segmented O shaped, or spiral shaped cut voids;

(g) wherein a circumferentially peripheral portion of said seal is bonded to said exterior rim by said fourth layer of adhesive sealing over said access opening;

(h) wherein said breakable configuration of either a varied, C shaped, O shaped, segmented O shaped, or spiral shaped cut voids defines a center portion of said seal;

(i) wherein said center portion breaks open and tears only in one or more weak areas of said breakable configuration of either a varied, C shaped, O shaped, segmented O shaped, or spiral shaped cut voids when a consumer applies sufficient external pushing pressure against said seal; and (j) wherein said center portion forms said integral pull opener when said seal is broken open providing access to said center portion thereby allowing said center portion to be pinched and pulled from said container by the consumer.

2. The combination of claim 1 wherein said breakable configuration of either a varied, C shaped, O shaped, segmented O shaped, or spiral shaped cut voids leaves one or more portions uncut forming one or more connectors that attach said center portion to said circumferentially peripheral portion of said seal bonded to said exterior rim.

3. The combination of claim 1, wherein said fourth layer of adhesive is of sufficient strength to cause said one or more connectors to tear from said circumferentially peripheral portion of said seal remaining bonded to said exterior rim when said center portion is pinched and pulled by said consumer.

4. The combination of claim 1, wherein said fourth layer of adhesive is of sufficient weakness to allow said circumferentially peripheral portion of said seal to peel from said exterior rim together with said center portion when said center portion is pinched and pulled by said consumer.

5. The combination of claim 1 wherein said first layer of frangible sheet material is comprised of one or more layers of same or different materials, wherein said materials are metal foil; polymers; plastic; synthetic foam; paper; or adhesive.

6. The combination of claim 1 wherein said third layer of strengthening sheet material is comprised of one or more layers of same or different materials, wherein said materials are metal foil; polymers; plastic; synthetic foam; paper; or adhesive.

7. The combination of claim 1 wherein said second layer of adhesive is comprised of one or more layers of same or different adhesives, wherein said adhesives are heat activated adhesive; evaporative adhesive; one or more part micro encapsulated adhesive; reactive adhesive; contact adhesive or combinations thereof.

8. The combination of claim 1 wherein said fourth layer of adhesive layer is comprised of one or more layers of same or different adhesives, wherein said adhesives are heat activated adhesive; evaporative adhesive; one or more part micro encapsulated adhesive; reactive adhesive; contact adhesive or combinations thereof.

9. The combination of claim 1 wherein said seal is bonded to said exterior rim by either induction sealing; conduction sealing; heat sealing; evaporative sealing; reactive sealing; compression sealing; contact sealing; ultrasonic sealing or combinations thereof.

10. The combination of claim 1 wherein said seal includes one or more additional layers of same or different sheet materials wherein said sheet materials are metal foil; plastic; polymers; synthetic foam; paper; absorptive material; adhesive; releasable adhesive and provides means for bonding said seal to said exterior rim by either induction sealing; conduction sealing; heat sealing; evaporative sealing; reactive sealing; compression sealing; contact sealing; ultrasonic sealing or combinations thereof.

11. A combination comprising a container comprised of a tubular body portion with a sealed bottom end and an opposite open top end ending with an exterior rim surrounding an access opening and providing a bonding surface for a seal, a tamper evident container seal with an integral pull opener for sealing over the access opening of said container; and a closure cap for securing to said container for covering over said seal and said access opening;

said seal comprising:

(a) a first layer of frangible sheet material and a second layer of strengthening sheet material;

(b) wherein said second layer of strengthening sheet material contains a breakable configuration of either a varied, C shaped, O shaped, segmented O shaped, or spiral shaped cut voids;

(c) wherein said first layer of frangible sheet material and said second layer of strengthening sheet material are adhesively bonded together forming said seal;

(d) wherein said breakable configuration of either a varied, C shaped, O shaped, segmented O shaped, or spiral shaped cut voids creates one or more weak areas in said seal by leaving only said first layer of frangible sheet material covering over said breakable configuration of either a varied, C shaped, O shaped, segmented O shaped, or spiral shaped cut voids cut voids;

(e) wherein a circumferentially peripheral portion of said frangible layer side of said seal is adhesively bonded to said exterior rim sealing over said access opening;

(f) wherein a circumferentially peripheral portion of said strengthening layer side of said seal is adhesively bonded to said exterior rim sealing over said access opening;

(g) wherein said breakable configuration of either a varied, C shaped, O shaped, segmented O shaped, or spiral shaped cut voids defines a center portion of said seal;

(h) wherein said center portion breaks open and tears only in said one or more weak areas of said breakable configuration of either a varied, C shaped, O shaped, segmented O shaped, or spiral shaped cut voids when a consumer applies sufficient external pushing pressure against said seal;

(i) wherein said center portion forms said integral pull opener when said seal is broken open providing access to said center portion thereby allowing said center portion be pinched and pulled from said container by the consumer;

(j) wherein said breakable configuration of either a varied, C shaped, O shaped, segmented O shaped, or spiral shaped cut voids leaves one or more portions uncut forming one or more connectors that attach said center portion to said circumferentially peripheral portion of said seal bonded to said exterior rim;

(k) wherein said one or more connectors are of sufficient weakness to tear from said circumferentially peripheral portion of said seal remaining bonded to said exterior rim when said center portion is pinched and pulled by said consumer, (l) wherein said one or more connectors are of sufficient strength to remain attached to said circumferentially peripheral portion of said seal bonded to said exterior rim forcing said circumferentially peripheral portion to peel from said exterior rim when said center portion is pinched and pulled by said consumer;

(m) wherein said first layer of frangible sheet material is comprised of one or more layers of same or different materials, wherein said materials are metal foil; polymers; plastic; synthetic foam; paper; or adhesive;

(n) wherein said second layer of strengthening sheet material is comprised of one or more layers of same or different materials, wherein said materials are metal foil; polymers; plastic; synthetic foam; paper; or adhesive;

(o) wherein said adhesive bonding said first layer of frangible sheet material to said second layer of strengthening sheet material is comprised of one or more layers of same or different adhesives, wherein said adhesives are heat activated adhesive; evaporative adhesive; one or more part micro encapsulated adhesive; reactive adhesive; contact adhesive or combinations thereof;

(p) wherein said adhesive bonding said seal to said exterior rim is comprised of one or more layers of either heat activated adhesive; evaporative adhesive; one or more part micro encapsulated adhesive; reactive adhesive; contact adhesive; or combinations thereof;

(q) wherein said seal is bonded to said exterior rim by induction sealing; conduction sealing; heat sealing; evaporative sealing; reactive sealing; compression sealing; contact sealing; ultrasonic sealing; or combinations thereof; and (r) wherein said seal includes one or more additional layers of same or different sheet materials wherein said sheet materials are metal foil; plastic; polymers; synthetic foam; paper; absorptive material; adhesive; releasable adhesive and provides means for bonding said seal to said exterior rim by either induction sealing; conduction sealing; heat sealing; evaporative sealing; reactive sealing; compression sealing; contact sealing; ultrasonic sealing; or combinations thereof.

12. A combination comprising a container comprised of a tubular body portion with a sealed bottom end and an opposite open top end ending with an exterior rim surrounding an access opening and providing a bonding surface for a seal, a tamper evident container seal with an integral pull opener for sealing over the access opening of said container; and a closure cap for securing to said container for covering over said seal and said access opening;

said seal comprising:

(a) a first layer of frangible sheet material; a second layer of strengthening sheet material and a third layer of frangible sheet material;

(b) wherein said second layer of strengthening sheet material contains a breakable configuration of either a varied, C shaped, O shaped, segmented O shaped, or spiral shaped cut voids;

(c) wherein said first layer of frangible sheet material, said second layer of strengthening sheet material, and said third layer of frangible sheet material are adhesively bonded together forming said seal;

(d) wherein said breakable configuration of either a varied, C shaped, O shaped, segmented O shaped, or spiral shaped cut voids creates one or more weak areas in said seal by leaving only said first layer of frangible sheet material and said third layer of frangible sheet material covering over said breakable configuration of either a varied, C shaped, O shaped, segmented O shaped, or spiral shaped cut voids;

(e) wherein a circumferentially peripheral portion of said seal is adhesively bonded to said exterior rim sealing over said access opening;

(f) wherein the configuration of said breakable configuration of either a varied, C shaped, O shaped, segmented O shaped, or spiral shaped cut voids defines a center portion of said seal;

(g) wherein said center portion breaks open and tears only in said one or more weak areas of said breakable configuration of either a varied, C shaped, O shaped, segmented O shaped, or spiral shaped cut voids when a consumer applies sufficient external pushing pressure against said seal;

(h) wherein said center portion forms said integral pull opener when said seal is broken open providing access to said center portion thereby allowing said center portion be pinched and pulled from said container by the consumer;

(i) wherein said breakable configuration of either a varied, C shaped, O shaped, segmented O shaped, or spiral shaped cut voids leaves one or more portions uncut forming one or more connectors that attach said center portion to said circumferentially peripheral portion of said seal bonded to said exterior rim;

(j) wherein said one or more connectors are of sufficient weakness to tear from said circumferentially peripheral portion of said seal remaining bonded to said exterior rim when said center portion is pinched and pulled by the consumer;

(k) wherein said one or more connectors are of sufficient strength to remain attached to said circumferentially peripheral portion of said seal bonded to said exterior rim forcing said circumferentially peripheral portion to peel from said exterior rim when said center portion is pinched and pulled by the consumer;

(l) wherein said first layer of frangible sheet material and said third layer of frangible sheet material are comprised of one or more layers of same or different materials, wherein said materials are metal foil; polymers; plastic; synthetic foam; paper; adhesive;

(m) wherein said second layer of strengthening sheet material is comprised of one or more layers of same or different materials, wherein said materials are metal foil; polymers; plastic; synthetic foam; paper, adhesive or combinations thereof;

(n) wherein said adhesive bonding said first layer of frangible sheet material and said third layer of frangible sheet material to said second layer of strengthening sheet material is comprised of one or more layers of same or different adhesives, wherein said adhesives are heat activated adhesive; evaporative adhesive; one or more part micro encapsulated adhesive; reactive adhesive; contact adhesive; or combinations thereof;

(o) wherein said adhesive bonding said seal to said exterior rim is comprised of one or more layers of same or different adhesives, wherein said adhesives are heat activated adhesive; evaporative adhesive; one or more part micro encapsulated adhesive; reactive adhesive; contact adhesive; or combinations thereof;

(p) wherein said seal is bonded to said exterior rim by either induction sealing; conduction sealing; heat sealing; evaporative sealing; reactive sealing; compression sealing; contact sealing; ultrasonic sealing; or combinations thereof; and (q) wherein said seal includes one or more additional layers of same or different sheet materials wherein, said sheet materials are metal foil; plastic; polymers; synthetic foam; paper; absorptive material; adhesive; releasable adhesive and provides means for bonding said seal to said exterior rim of said container by either induction sealing; conduction sealing; heat sealing; evaporative sealing; reactive sealing; compression sealing; contact sealing; ultrasonic sealing or combinations thereof.

13. A combination comprising a container comprised of a tubular body portion with a sealed bottom end and an opposite open top end ending with an exterior rim surrounding an access opening and providing a bonding surface for a seal, a tamper evident container seal with an integral pull opener for sealing over the access opening of said container; and a closure cap for securing to said container for covering over said seal and said access opening;

said seal comprising:

(a) a first layer of strengthening sheet material; a second layer of frangible sheet material; a third layer of strengthening sheet material;

(b) wherein said first layer of strengthening sheet material and said third layer of strengthening sheet material each contain a breakable configuration of either a varied, C shaped, O shaped, segmented O shaped, or spiral shaped cut voids;

(c) wherein said breakable configuration of either a varied, C shaped, O shaped, segmented O shaped, or spiral shaped cut voids in said first layer of strengthening sheet material and said third layer of strengthening sheet material are duplicates of each other;

(d) wherein said first layer of strengthening sheet material, said second layer of frangible sheet material, and said third layer of strengthening sheet material are adhesively bonded together forming said seal;

(e) wherein said breakable configuration of either a varied, C shaped, O shaped, segmented O shaped, or spiral shaped cut voids in said first layer of strengthening sheet material and said breakable configuration of either a varied, C shaped, O shaped, segmented O shaped, or spiral shaped cut voids in said third layer of strengthening sheet material are in alignment with each other;

(f) wherein said breakable configuration of either a varied, C shaped, O shaped, segmented O shaped, or spiral shaped cut voids create one or more weak areas in said seal by leaving only said second layer of frangible sheet material present between said first layer of strengthening sheet material and said third layer of strengthening sheet material in the area of said breakable configuration of either a varied, C shaped, O shaped, segmented O shaped, or spiral shaped cut voids;

(g) wherein a circumferentially peripheral portion of said seal is adhesively bonded to said exterior rim sealing over said access opening;

(h) wherein said wherein said breakable configuration of either a varied, C shaped, O shaped, segmented O shaped, or spiral shaped cut voids defines a center portion of said seal;

(i) wherein said center portion breaks open and tears only in said one or more weak areas of said breakable configuration of either a varied, C shaped, O shaped, segmented O shaped, or spiral shaped cut voids when a consumer applies sufficient external pushing pressure against said seal;

(j) wherein said center portion forms said integral pull opener when said seal is broken open providing access to said center portion thereby allowing said center portion be pinched and pulled from said container by the consumer;

(k) wherein said breakable configuration of either a varied, C shaped, O shaped, segmented O shaped, or spiral shaped cut voids leaves one or more portions uncut forming one or more connectors that attach said center portion to said circumferentially peripheral portion of said seal bonded to said exterior rim;

(l) wherein said one or more connectors are of sufficient weakness to tear from said circumferentially peripheral portion of said seal remaining bonded to said exterior rim when said center portion is pinched and pulled by the consumer;

(m) wherein said one or more connectors are of sufficient strength to remain attached to said circumferentially peripheral portion of said seal bonded to said exterior rim forcing said circumferentially peripheral portion to peel from said exterior rim when said center portion is pinched and pulled the said consumer;

(n) wherein said first layer of strengthening sheet material and said third layer of strengthening sheet material are comprised of one or more layers of same or different materials, wherein said materials are metal foil; plastic; polymers; synthetic foam; paper; adhesive;

(o) wherein said second layer of frangible sheet material is comprised of one or more layers of same or different materials, wherein said materials are metal foil; plastic; polymers; synthetic foam; paper; adhesive;

(p) wherein said adhesive bonding said first layer of strengthening sheet material and said third layer of strengthening sheet material to said second layer of frangible sheet material is comprised of one or more layers of same or different adhesives, wherein said adhesives are heat activated adhesive; evaporative adhesive; one or more part micro encapsulated adhesive; reactive adhesive; contact adhesive or combinations thereof;

(q) wherein said adhesive bonding said seal to said exterior rim is comprised of one or more layers of same or different adhesives, wherein said adhesives are heat activated adhesive; evaporative adhesive; one or more part micro encapsulated adhesive; reactive adhesive; contact adhesive; or combinations thereof;

(r) wherein said seal is bonded to said exterior rim by either induction sealing; conduction sealing; heat sealing; evaporative sealing; reactive sealing; compression sealing; contact sealing; ultrasonic sealing; or combinations thereof; and (s) wherein said seal includes one or more additional layers of same or different sheet materials, wherein said sheet materials are metal foil; plastic; polymers; synthetic foam; paper; absorptive material; adhesive; releasable adhesive; or combinations thereof and provides means for bonding said seal to said exterior rim by either induction sealing; conduction sealing; heat sealing; evaporative sealing; reactive sealing; compression sealing; contact sealing; ultrasonic sealing; or combinations thereof.

* * * * *